United States Patent [19]

Tsuji et al.

[11] Patent Number: 4,724,933

[45] Date of Patent: Feb. 16, 1988

[54] DISPLAY APPARATUS FOR ELEVATOR

[75] Inventors: Shintaro Tsuji; Yasukazu Umeda, both of Inazawa, Japan

[73] Assignee: Mitsubishi Denki Kabushiki Kaisha, Japan

[21] Appl. No.: 40,251

[22] Filed: Apr. 20, 1987

[30] Foreign Application Priority Data

| | | | |
|---|---|---|---|
| Apr. 21, 1986 | [JP] | Japan | 61-91527 |
| Apr. 22, 1986 | [JP] | Japan | 61-92572 |
| May 22, 1986 | [JP] | Japan | 61-117922 |
| May 22, 1986 | [JP] | Japan | 61-117923 |

[51] Int. Cl.[4] ..... B66B 3/00

[52] U.S. Cl. ..... 187/137

[58] Field of Search ..... 187/135, 137

[56] References Cited

U.S. PATENT DOCUMENTS

| | | | |
|---|---|---|---|
| 4,032,882 | 6/1977 | Mandel et al. | 187/137 |

FOREIGN PATENT DOCUMENTS

| | | | |
|---|---|---|---|
| 52-64739 | 5/1977 | Japan | 187/137 |
| 53-13750 | 2/1978 | Japan | 187/135 |
| 53-119549 | 10/1978 | Japan | 187/137 |
| 54-47261 | 4/1979 | Japan . | |
| 54-65955 | 5/1979 | Japan | 187/135 |
| 56-20266 | 5/1981 | Japan . | |
| 61-248879 | 11/1986 | Japan . | |
| 1568656 | 6/1980 | United Kingdom | 187/137 |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

In a display apparatus for an elevator wherein a display unit disposed in a cage or a hall of the elevator is divided into two display regions, and as the cage approaches the hall, a lighting area in the first display region is gradually decreased, while a lighting area in the second display region is gradually increased; a display apparatus for an elevator characterized by comprising first calculation means for calculating and delivering a distance or a time interval which is required for the cage to arrive at the hall, second calculation means for calculating and delivering a movement distance or a lapsed time which is taken with respect to a designated point of time, first display control means for displaying the quantity corresponding to the output of the first calculation means, in terms of the lighting area of the first display region, and second display control means for displaying the quantity corresponding to the output of the second calculation means, in terms of the lighting area of the second display region.

15 Claims, 36 Drawing Figures

DISPLAY APPARATUS FOR ELEVATOR

This invention relates to an apparatus which is installed in the cage or hall of an elevator to display the situation of the approach of the cage to the hall.

It has heretofore been common that an elevator user waiting for the arrival of a cage in a hall knows the positions and running directions of cages from the operations of cage position display units and judges which of the cages will come to his/her floor earliest, whereupon he/she gets ready in front of a hall door corresponding to the particular cage.

However, as the number of installed cages increases, it becomes very difficult to judge and find the desired cage on the basis of the positions and running directions of the cages changing every moment. A system has therefore been proposed wherein, as disclosed in the official gazette of Japanese Patent Application Publication No. 20266/1981, the periods of time required for cages responsive to a hall call to arrive at the corresponding hall are calculated, and they are displayed as predictive wait times in the hall in correspondence with the respective cages, to inform a waiting user of how long he/she may wait till the arrivals of the cages, thereby intending to obviate the sense of unease or the sense of irritation of the waiting user. The system which displays the wait times in terms of numerals in this fashion (hereinbelow, called "numeral display system") has the merit that even a person who utilizes the elevator for the first time can readily understand the fact that the display contents signify the wait times. On the other hand, however, it simultaneously has the problem that, when the predicted wait time and the current display content are discrepant, the alteration of the display content offends the eye to rather impose the sense of distrust or the sense of irritation on the waiting user.

With the intention of eliminating the problem of the numeral display system, there has also been proposed a system wherein, as disclosed in the official gazette of Japanese Patent Application Laid-open No. 47261/1979, the approach of a cage is diagrammatically guided by increasing the lighting-up area of an indicator lamp (hereinbelow, called "diagrammatic display system"). Since, however, the diagrammatic display system guides the approach of the cage diagrammatically, what the lighting-up display signifies is difficult to understand for a waiting person who utilizes the elevator for the first time, and this results in the problem that the effect of the display unit cannot be sufficiently demonstrated.

Therefore, in order to make even the first utilizing person capable of readily understanding the display content and to prevent the sense of distrust or the sense of irritation from being caused even at the time of the alteration of the display content, an apparatus has been proposed wherein a display unit which is divided into two display regions not overlapping each other is disposed in a cage or hall, and as the cage approaches the hall, the indicating area (lighting-up area) of the first display region is decreased gradually, while the indicating area (lighting-up area) of the second display region is correspondingly increased gradually, whereby the situation of the approach of the cage is displayed. This apparatus will be described with reference to FIGS. 1-5.

FIG. 1 is a general arrangement diagram for clearly showing the arrangement of the prior-art example. Letter A denotes approach situation calculation means for calculating and delivering the situation of the approach of a cage to a hall, while letter B denotes a display unit which is installed in the hall and which has three display regions B1, B2 and B3 not overlapping one another. Shown at letter C is display control means for controlling the respective lighting-up areas of the two display regions B1 and B2 of the display unit B and for controlling the display aspect of the display region 3. On the basis of the output of the approach situation calculation means A, the display control means C gradually decreases the lighting-up area of the first display region and gradually increases the lighting-up area of the second display region as the cage approaches the hall, while it periodically changes the lighting-up aspect in the third display region at the same time.

FIG. 2 shows a hall on the third floor of a six-storeyed building in which two cages are juxtaposed. Symbols D1 and D2 denote the doors of the hall corresponding to the cages No. 1 and No. 2, respectively. A hall control panel H has an up button and a down button. Symbols U1 and U2 represent up hall lanterns corresponding to the cages No. 1 and No. 2, respectively, and symbols L1 and L2 similar down hall lanterns. Symbols UT1 and UT2 represent up wait time display units which display the situations of approaches at the responses of the cages No. 1 and No. 2 to an up call, respectively, while symbols LT1 and LT2 represent down wait time display units which similarly display the situations of approaches at the responses to a down call.

FIG. 3 is a diagram showing the details of the up wait time display unit UT1 for the cage No. 1 on the third floor. In the figure, numerals 1-5 denote indicator lamps belonging to the first display region B1 respectively, numerals 6-10 denote indicator lamps belonging to the second display region B2 respectively, and symbols 11A-11D denote indicator lamps belonging to the third display region B3 respectively.

FIG. 4 is a circuit diagram showing that display control circuit C1*u* in the display control means C which controls the up wait time display unit UT1 for the cage No. 1 on the third floor. The display control means C is constructed of similar circuits as regards the down direction, the other floors and the other cage. Referring to the figure, numeral 12 denotes a well-known allotment device which allots an up call and a down call registered by the hall control panel H etc., to the cage No. 1 or No. 2 and which delivers allotment signals. The allotment signal 113*u* becomes "H" (a high level) when the cage No. 1 has been assigned to the up call on the third floor, while it becomes "L" (a low level) when the assigned cage has responded to the call. A well-known arrival expectation time calculation device 13 calculates and delivers the individual predictive values (namely, arrival expectation times) of the periods of time in which the cages Nos. 1 and 2 arrive at the halls of the first-sixth floors in the up direction and down direction in response to cage calls and the allotted hall calls, respectively. Letter t denotes an arrival expectation time signal (issued at intervals of 5 seconds) for the ascent of the cage No. 1 on the third floor. A cage control device 14 for the cage No. 1 controls travel operations such as determining the running direction and travel/stop, operations for opening or closing a door, etc. in order to respond to the call. Symbol 143*u* denotes a just-after-arrival signal which is delivered from the cage control device 14 of the cage No. 1, and which becomes "H" for only a time interval from the arrival of the cage No. 1 till the beginning of the door opening operation when this cage is assigned to the up call of the third floor and it arrives at the third floor in the up direction in response thereto. Shown at numerals 21–25 are comparators each of which brings the output signal of a point Z to "H" when the input signal of a point X≧the input signal of a pont Y holds, and brings the output signal of the point Z to "L" at the other time. Constant value signals T1–T5 satisfy the relationship of T1<T2<T3<T4<T5, and are respectively set at 1 second, 6 seconds, 11 seconds, 16 seconds and 21 seconds. Numerals 31–42 indicate AND gates, numerals 45–49 OR gates, numeral 50 a pulse generator for producing a pulse signal 50*a* which repeats "H" and "L" in succession every 0.5 second, and numerals 51–56 NOT gates.

FIG. 5 is a diagram showing the changes of the display states of the up wait time display unit UT1 in FIG. 3 (in which hatched parts illustrate lighting-up states).

Next, the operation of the prior-art example will be described.

It is assumed that a waiting person have depressed the up button to register an up call on the third floor, and that the allotment device 12 have assigned the cage No. 1 to this call. At this time, the third-floor up allotment signal 113*u* for the cage No. 1 becomes "H." On the other hand, it is assumed that the third-floor up arrival expectation time signal t for the cage No. 1 have been calculated as 25 seconds and delivered by the arrival expectation time calculation device 13. Then, all the outputs of the comparators 21–25 become "H," so that all the outputs of the AND gates 31–35 become "H" to light up the indicator lamps 1–5 of the first display region B1. Meanwhile, since all the outputs of the NOT gates 51–55 are "L," the outputs of the AND gates 36–40 become "L," and besides, the just-after-arrival signal 143*u* is "L," so that the outputs of the OR gates 45–49 become "L" to keep the indicator lamps 6–10 of the second display region B2 extinguished. In addition, while the periodic pulse signal 50*a* is "L," the output of the AND gate 41 becomes "L," that of the NOT gate 56 becomes "H" and that of the AND gate 42 becomes "H," so that the indicator lamps 11A and 11C are extinguished with those 11B and 11D being lit up. To the contrary, while the periodic pulse signal 50*a* is "H," the output of the AND gate 41 becomes "H," that of the NOT gate 56 becomes "L" and that of the AND gate 42 becomes "L," so that the indicator lamps 11A and 11C are lit up with those 11B and 11D being extinguished. As a result, the set of the indicator lamps 11A and 11C of the third display region B3 and the set of the indicator lamps 11B and 11D repeat the lighting and the extinction alternately every 0.5 second. The state in which the sand of an hourglass is falling is expressed by the flickering. This flickering is continued while the allotment signal 113*u* is "H." When the arrival expectation time signal t takes a value not smaller than the constant value signal T5 in this manner, the state shown in (a) of FIG. 5 is established. (The indicator lamps 11A–11D flicker.)

Next, it is assumed that the cage No. 1 have approached the third floor to change the arrival expectation time signal t from 25 seconds to 20 seconds. On this occasion, t (=20 seconds)<T5 (=21 seconds) holds, and only the output of the comparator 25 changes as "H"→"L," so that the output of the AND gate 35 changes as "H"→"L" to extinguish the indicator lamp 5 of the first display region B1. Simultaneously, since the output of the NOT gate 55 changes as "L"→"H," the output of the AND gate 36 changes as "L"→"H" and that of the OR gate 45 changes as "L"→"H," whereby the indicator lamp 6 of the second display region B2 is lit up. Accordingly the display state of the display unit UT1 on this occasion changes from (a) to (b) in FIG. 5.

Further, assuming that the cage No. 1 have approached the third floor to change the arrival expectation time signal t from 20 seconds to 15 seconds, 10 seconds and 5 seconds in succession, the outputs of the comparators 24, 23 and 22 change as "H"→"L" in the order mentioned. Consequently, the outputs of the AND gates 34, 33 and 32 change as "H"→"L" in this order, those of the AND gates 37, 38 and 39 change as "L"→"H" in this order, and those of the OR gates 46, 47 and 48 change as "L"→"H" in this order. Accordingly, the indicator lamps 4, 3 and 2 of the first display region B1 are successively extinguished, whereas the indicator lamps 7, 8 and 9 of the second display region B2 are successively lit up. Thus, when the arrival expectation time signal t has changed from 20 seconds down to 5 seconds, the display state of the display unit UT1 changes from (b) to (c), (d) and (e) in FIG. 5 in succession.

Thereafter, when the cage No. 1 has arrived at the third floor in the up direction, the third-floor up call is canceled to bring the allotment signal 113*u* to "L." At the same time, the just-after-arrival signal 143*u* becomes "H," and the arrival expectation time signal t becomes 0 second. Accordingly, all the outputs of the AND gates 31–42 become "L," whereupon the indicator lamps 1–5 of the first display region B1 and those 11A–11D of the third display region B3 are all extinguished. Besides, since the just-after-arrival signal 143*u* becomes "H," all the outputs of the OR gates 45–49 become "H," whereupon the indicator lamps 6–10 of the second display region B2 are all lit up. At this time, the display state of the display unit UT1 changes from (e) to (f) in FIG. 5.

Lastly, when the cage No. 1 has started the door opening operation on the third floor, the just-after-arrival signal 143*u* becomes "L," and all the outputs of the OR gates 45–49 become "L." Therefore, the indicator lamps 6–10 of the second display region B2 are all extinguished to establish the same state as the state before the registration of the hall call. By the way, when the up call on the third floor is allotted to the cage No. 2, not to the cage No. 1 (the allotment signal 113*u*="L"), all the outputs of the AND gates 31–42 become "L." Therefore, the display unit UT1 of the cage No. 1 is held extinguished, and a user waiting for the cage No. 2 is not puzzled.

In this manner, with the prior-art example, when the arrival expectation time signal t becomes smaller with the approach of the cage, the area in which the indicator lamps of the first display region B1 are lit up is decreased, while at the same time, the area in which the indicator lamps of the second display region B2 are lit up is increased from the state of null area. Thus, the approach situation of the cage is displayed in the display aspect similar to that of the hourglass, and even a person who utilizes the elevator for the first time can grasp the display content.

In the prior-art example, however, the lighting area of the indicator lamps of the first display region B1 informs the waiting person of the predictive value till the arrival of the cage, whereas the lighting area of the indicator lamps of the second display region B2 merely expresses (the maximum wait time which can be displayed)—(the lighting area of the indicator lamps of the first display region B1) and does not give the waiting person any significant information. Further, it is reasonably considered that some waiting persons might misunderstand the lighting area of the indicator lamps of the second display region B2 as the period of time during which they have waited till then, by association with the hourglass and might bear the sense of irritation or suspicion. In this manner, the prior-art example described above has had the problem that the waiting persons are caused to bear the unnecessary sense of irritation or suspicion.

Besides, in the prior-art example, when the arrival expectation time at the point of time at which the hall call has been allotted is 25 seconds, the display begins with the state (a) in FIG. 5, whereas when the arrival expectation time at the point of time at which the hall call has been allotted is 15 seconds, the display begins with the state (c) in FIG. 5, that is, the state in which the indicator lamps 1, 2 and 3 of the first display region B1 and those 6 and 7 of the second display region B2 are lit up. Accordingly, the display starts under the state under which the sand accumulates in the lower part of the hourglass from the first. Therefore, it is reasonably considered that, by association with the hourglass, the waiting persons might be given an erroneous impression as if they have already waited for the corresponding time interval, and that some waiting users might bear the sense of irritation or suspicion. In this manner, the prior-art example has had the problem that the waiting persons are caused to bear the unnecessary sense of irritation or suspicion.

Further, in the prior-art example, the wait time expressed by the lighting area of one indicator lamp is 5 seconds, in other words, the unit time of one indicator lamp is fixed to 5 seconds, so that the maximum wait time (arrival expectation time) which can be displayed at the point of time of the allotment of the hall call is limited to 25 seconds. Accordingly, when the arrival expectation time is 40 seconds by way of example, the display begins with the state (a) in FIG. 5, and this state (the state in which the upper part of the hourglass is filled up with the sand and in which the sand is falling) is held continued until the arrival expectation time becomes 20 seconds. It is therefore impossible to judge whether the wait time till the arrival of the cage is just equal to the maximum wait time or is longer than it, and the waiting persons are caused to bear the sense of suspicion or irritation unnecessarily.

SUMMARY OF THE INVENTION

This invention has been made in order to solve the problems as stated above, and has for its object to provide a display apparatus for an elevator wherein the approach situation of a cage is guided by a display unit divided into two display regions, according to which the significances of the lighting areas of the display regions are not misunderstood by a waiting person, so that the waiting person is not caused to bear the unnecessary sense of irritation or suspicion.

Another object of this invention is to provide a display apparatus for an elevator wherein the approach situation of a cage is guided by a display unit divided into two display regions, according to which even when a quantity expressive of the approach situation (for example, an arrival expectation time) exceeds the maximum value displayable with the lighting areas of the display regions (for example, the maximum wait time), a waiting person is not caused to bear the unnecessary sense of irritation or suspicion.

An apparatus according to this invention consists in a display apparatus for an elevator wherein a display unit disposed in the cage or hall of the elevator is divided into two display regions not overlapping each other and wherein as the cage approaches the hall, a lighting area in the first display region is gradually decreased, while a lighting area in the second display region is gradually increased, the display apparatus being so constructed that a distance or a period of time which is required for the cage to arrive at the hall is calculated and delivered by first calculation means, while a distance or a period of time by or for which the cage has hitherto approached since a designated point of time is calculated and delivered by second calculation means, and that the quantity corresponding to the output of the first calculation means is displayed in terms of the lighting area of the first display region by first display control means, while the quantity corresponding to the output of the second calculation means is displayed in terms of the lighting area of the second display region by second display control means. Thus, as the cage approaches the quantity corresponding to the distance or the period of time which is required for the cage to arrive at the hall is displayed in one display region of the display unit installed in the cage or hall, while the quantity corresponding to the distance or the period of time by or for which the cage has hitherto approached since the designated point of time is displayed in the other display region.

In addition, an apparatus according to this invention consists in a display apparatus for an elevator wherein a display unit disposed in the cage or hall of the elevator is divided into two display regions not overlapping each other and wherein as the cage approaches the hall, a lighting area in the first display region is gradually decreased, while a lighting area in the second display region is gradually increased, the display apparatus being so constructed that a distance or a period of time which is required for the cage to arrive at the hall is calculated and delivered by first calculation means, that the quantity which corresponds to the output of the first calculation means is displayed in terms of the lighting area of the first display region by first display control means, that a quantity in which the output of the first calculation means has decreased by a current point of time since a point of time of the start of the operation of the first display control means is calculated and delivered by third calculation means, and that the lighting area of the second display region is gradually increased from a null state in correspondence with the output of the third calculation means by second display control means. Thus, as the cage approaches, the quantity corresponding to the distance or the period of time which is required for the cage to arrive at the hall is displayed in one display region of the display unit installed in the cage or hall, while the quantity corresponding to the distance or the period of time which has decreased since the point of time of the start of the display of one display region is displayed in the other display region.

Further, an apparatus according to this invention consists in a display apparatus for an elevator in which a display unit disposed in the cage or hall of the elevator is endowed with three sorts of display regions, and which has first calculation means for calculating and delivering a distance or a time interval required for the cage to arrive at the hall, display command means for delivering a command for operating the display unit while a condition previously determined for the hall holds, first display control means for displaying the quantity corresponding to the output of the first calculation means in terms of the lighting area of the first display area when the display command means is operating, second display control means for presenting a display by increasing the lighting area of the second display region in accordance with the decrease of the lighting area of the first display region when the display command means is operating, and third display control means for displaying in terms of the change of the lighting aspects of the third display region the fact that the first display control means and the second control means are respectively performing the decremental operation and the incremental operation, the display apparatus being so constructed that when the output of said first calculation means exceeds the quantity corresponding to the maximum lighting area of said first display region, said display command means commands said first display control means to present the display with the maximum lighting area, commands said second display control means to present the display with the minimum lighting area, and commands said third display control means to inhibit the display operation thereof, and that when the output of said first calculation means does not exceed the quantity corresponding to the maximum lighting area of said first display region, said display command means commands said first display control means to present the display with the corresponding lighting area, commands said second display control means to present the display while increasing the lighting area of said second display region in accordance with the decrease of the lighting area of said first display region, and commands said third display control means to perform the display operation thereof. Thus, when the quantity corresponding to the distance or the time interval required for the cage to arrive at the hall exceeds the quantity corresponding to the maximum lighting area of the first display region of the display unit disposed in the cage or the hall, the display of the first display region is presented in the state in which the lighting area is maximized, the display of the second display region is presented in the state in which the lighting area is minimized, and the display operation of the third display region is inhibited. On the other hand, when the quantity corresponding to the distance or the time interval does not exceed the quantity corresponding to the maximum lighting area of the first display region of the display unit, the lighting area of the first display region is gradually decreased in accordance with the quantity corresponding to the distance or the time interval, the lighting area of the second display region is gradually increased in accordance with the decrease of the lighting area of the first display region, and the display operation of the third display region is performed.

Besides, an apparatus according to this invention consists in a display apparatus for an elevator wherein a display unit disposed in the cage or hall of the elevator is divided into two display regions and wherein as the cage approaches the hall, a lighting area in the first display region is gradually decreased, while a lighting area in the second display region is gradually increased, the display apparatus being so constructed that each of the display regions includes a plurality of unit display regions, that a distance or a time interval required for the cage to arrive at the hall is calculated and delivered by first calculation means, that a distance or a time interval expressed per unit display region is set according to the output of the first calculation means at the point of time of the start of display by unit display magnitude setting means, that the display is started by first display control means from a state in which the number of the unit display regions lit up within the first display region is set at the maximum number, whereupon as the output of the first calculation means becomes smaller, the number of the unit display regions lit up within the first display region is decreased more on the basis of the unit display magnitude set by the unit display magnitude setting means, and that the display is started by second display control means from a state in which the number of the unit display regions lit up within the second display region is set at the minimum number, whereupon as the output of the first calculation means becomes smaller, the number of the unit display regions lit up within the second display region is increased more on the basis of the unit display magnitude set by the unit display magnitude setting means. Thus, the quantity equivalent to the distance or the time interval required for the cage to arrive at the hall is displayed in one display region of the display unit disposed in the cage or the hall so as to start the display from the state in which the lighting area of this display region is maximized, and to gradually decrease the lighting area, the quantity equivalent to the distance or the time interval having decreased since the start of the display of the above display region is displayed in the other display region so as to start from a state in which the lighting area is minimized, and to gradually increase the lighting area, and the unit display magnitude is changed according to the distance or the time interval at the point of time of the start of the display so as to decrease and increase the lighting areas on the basis of the changed unit display magnitude.

BRIEF DESCRIPTION OF THE DRAWINGS

FIG. 1–FIGS. 5(*a*) thru 5(*f*) illustrate a prior-art example, in which FIG. 1 is a general arrangement diagram of the prior-art display apparatus for an elevator, FIG. 2 is a front view of the hall of the elevator, FIG. 3 is a front view of a wait time display unit, FIG. 4 is a circuit diagram showing part of a display control circuit in the prior art, and FIGS. 5(*a*) thru 5(*f*) are explanatory diagrams showing the changes of the display state of the display unit;

FIG. 6–FIG. 9 illustrate the first embodiment of a display apparatus for an elevator according to this invention, in which FIG. 6 is a general arrangement diagram, FIG. 7 is a circuit diagram showing part of a display control circuit, FIG. 8 is a front view showing the display state of a display unit, and FIG. 9 is a circuit diagram of essential portions showing a modification of the first embodiment;

FIG. 10–FIGS. 13(*a*) thru 13(*e*) illustrate the second embodiment of the display apparatus for an elevator according to this invention, in which FIG. 10 is a general arrangement diagram, FIG. 11 is a diagram of a display control circuit for controlling an up wait time display unit, FIG. 12 is a detailed circuit diagram of a decrement calculation device, and FIGS. 13(*a*) thru 13(*e*) are explanatory diagrams showing the display states of the up wait time display unit;

FIG. 14–FIGS. 17(*a*) and 17(*b*) illustrate the third embodiment of the display apparatus for an elevator according to this invention, in which FIG. 14 is a general arrangement diagram, FIG. 15 is a diagram of a control circuit for a wait time display unit, FIG. 16 is a detailed circuit diagram of a decrement calculation device (161) as well as a display command device (71), and FIGS. 17(*a*) and 17(*b*) are explanatory diagrams each showing the display state of the wait time display unit; and FIG. 18–FIGS. 21(*a*) thru 21(*f*) illustrate the fourth embodiment of the display apparatus for an elevator according to this invention, in which FIG. 18 is a general arrangement diagram, FIG. 19 is a diagram of a control circuit for a wait time display unit, FIG. 20 is a detailed circuit diagram of a unit display magnitude calculating device (260) as well as a constant value setting device (261), and FIGS. 21(*a*) thru 21(*f*) are explanatory diagrams each showing the display state of the wait time display unit.

PREFERRED EMBODIMENTS OF THE INVENTION

Figure 8:
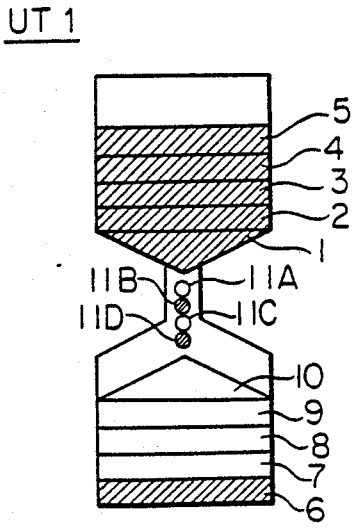

Now, the first embodiment of this invention will be described with reference to FIGS. 6–8.

Figure 6:
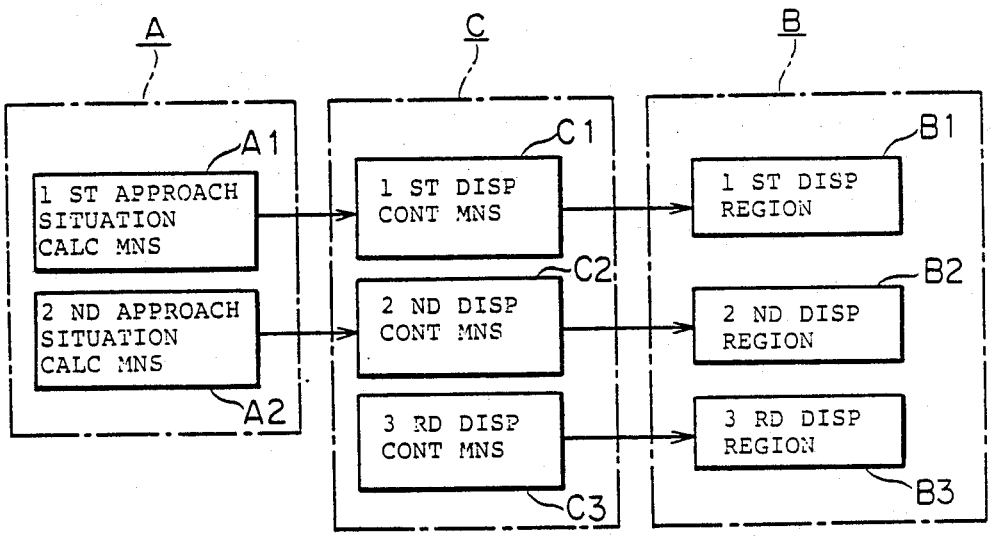

FIG. 6 is a general arrangement diagram for clearly showing the arrangement of the first embodiment of this invention. Approach situation calculation means A is constructed of first calculation means A1 for calculating and delivering a distance or a time interval which is required for a cage to arrive at a hall, and second calculation means A2 for calculating and delivering a distance or a time interval by or for which the cage has hitherto approached since a designated point of time. Display control means C is constructed of first display control means C1 for displaying the quantity corresponding to the output of the first calculation means A1 in terms of the lighting area of the first display region B1 of a display unit B, second display control means C2 for displaying the quantity corresponding to the output of the second calculation means A2 in terms of the lighting area of the second display region B2, and third display control means C3 for periodically changing the lighting aspect of the third display region B3 in order to express that the lighting areas of the first display region B1 and the second display region B2 are being decreased and increased.

Figure 1:
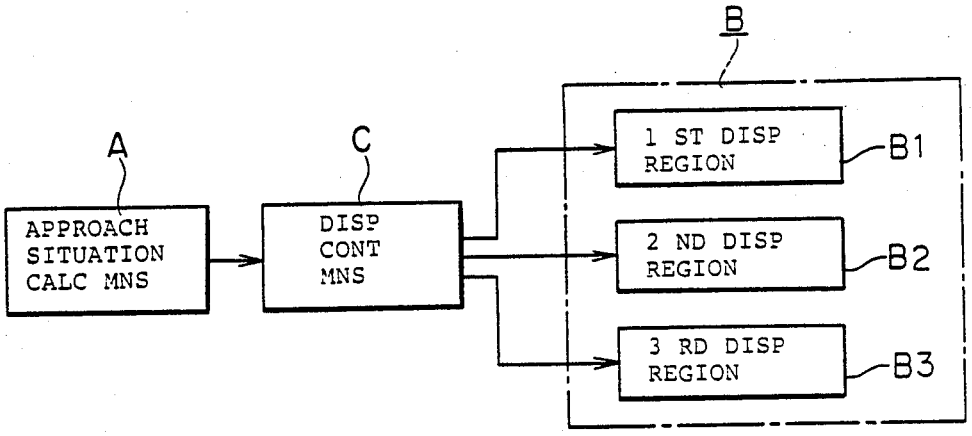
Figure 2:
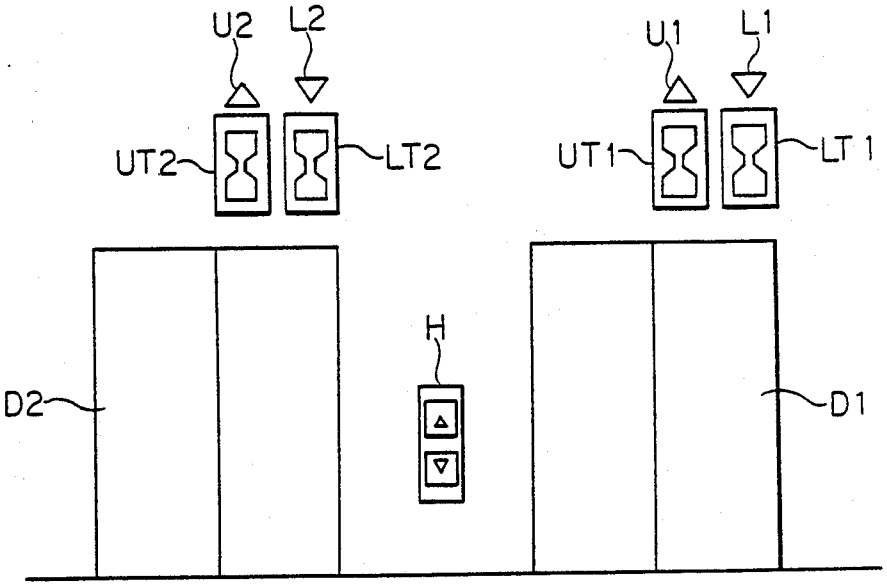
Figure 3:
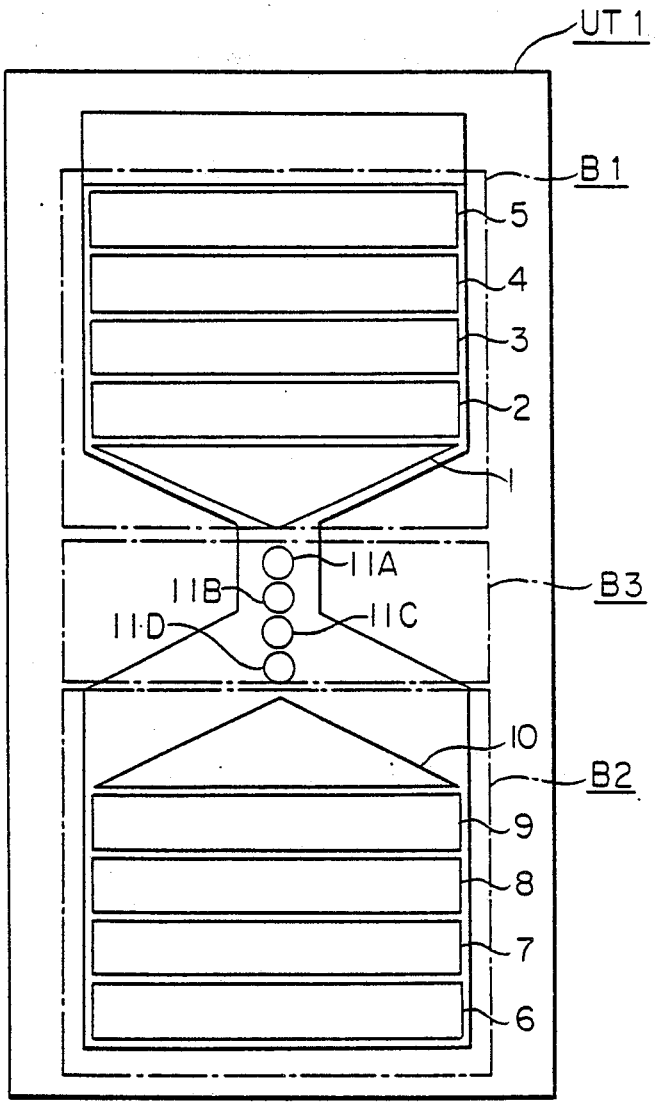
Figure 4:
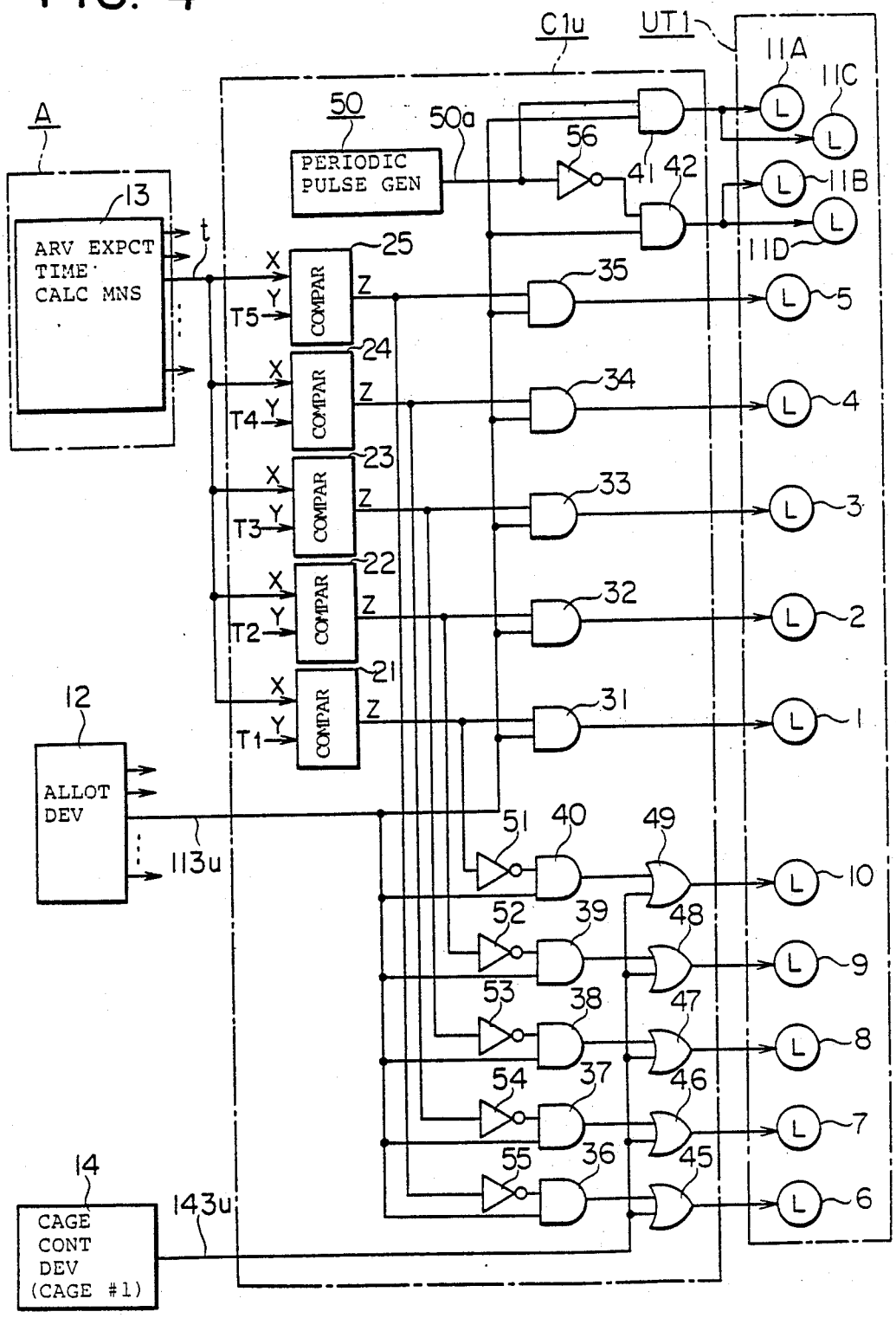
Figure 7:
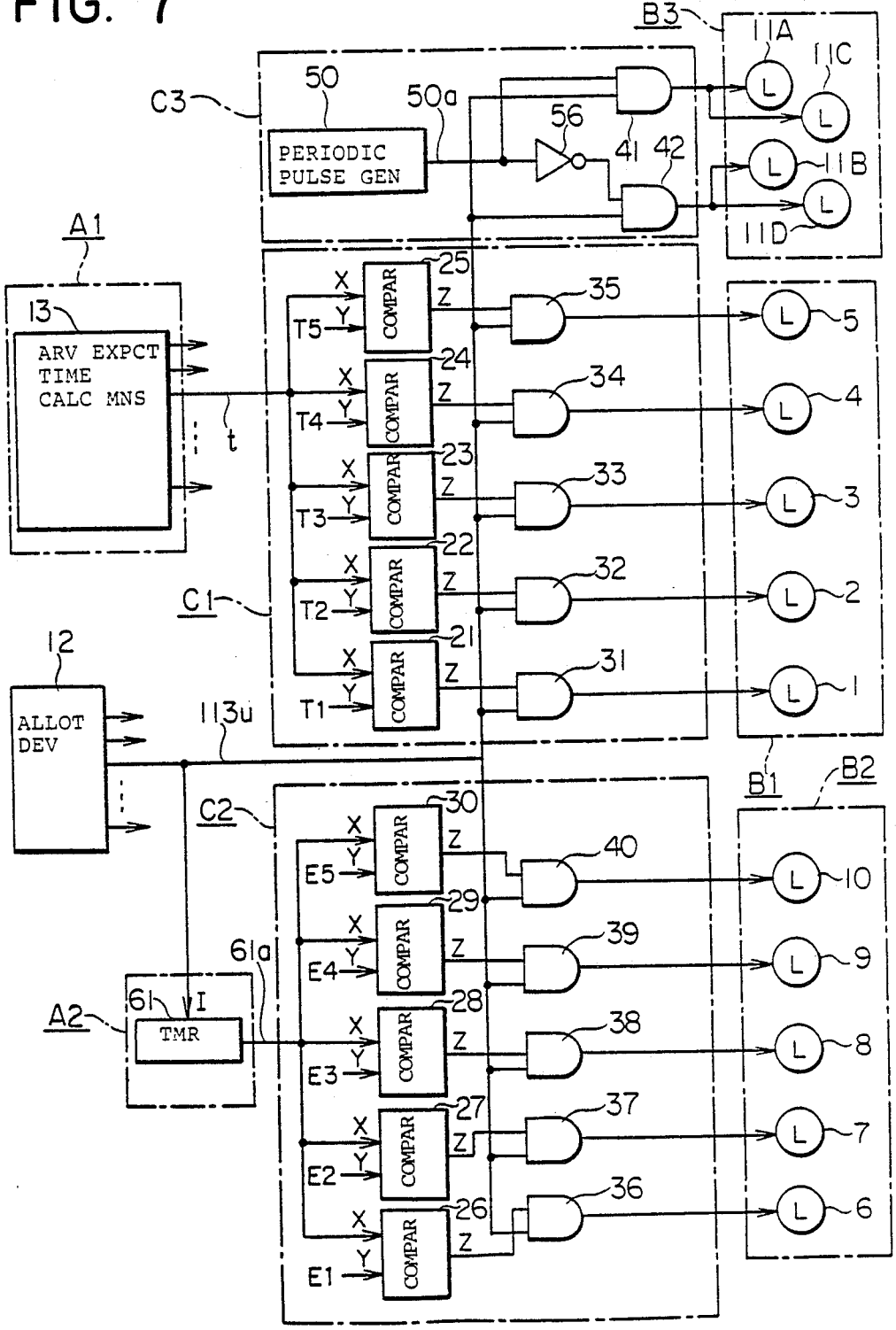

FIG. 7 is a circuit diagram corresponding to FIG. 4 of the prior-art example, and showing that display control circuit C1*u* in the display control means C which controls an up wait time display unit UT1 for the cage No. 1 on the third floor. The display control means C is constructed of similar circuits as regards the down direction, the other floors and the other cage. In FIG. 7, numerals 26–30 indicate comparators which are similar to the comparators 21–25. Symbols E1–E5 denote constant value signals which satisfy the relationship of $E1<E2<E3<E4<E5$, and which are respectively set at 5 seconds, 10 seconds, 15 seconds, 20 seconds and 25 seconds. Numeral 61 denotes a timer by which, when a signal of "H" is received at a point I, the lapsed time thereof (in seconds) is counted to provide a lapsed time signal 61*a*, and when a signal of "L" is received at the point I, the lapsed time signal 61*a* is made zero. The timer 61 constructs the second calculation means A2.

Next, the operation of this embodiment will be described.

It is assumed that a waiting person have depressed the up button to register an up call on the third floor, and that the allotment device 12 have assigned the cage No. 1 to this call. Since, at this time, the third-floor up allotment signal 113*u* for the cage No. 1 becomes "H," the display by the indicator lamps 1–10 and 11A–11D becomes possible. Thus, assuming that the third-floor up arrival expectation time signal t for the cage No. 1 have been calculated and delivered as 30 seconds by the arrival expectation time calculation device 13, all the outputs of the comparators 21–25 become "H," so that all the outputs of the AND gates 31–35 become "H" to light up the indicator lamps 1–5 of the first display region B1. Meanwhile, since the allotment signal 113*u* having become "H" is applied to the point I of the timer 1, the lapsed time since the assignment of the cage No. 1 to the hall call is thereafter calculated until the allotment signal 113*u* becomes "L."

Before a time interval of 5 seconds lapses since the allotment of the third-floor up call, for example, when the lapsed time signal 61*a* is 3 seconds, all the outputs of the comparators 26–30 are "L," and hence, all the outputs of the AND gates 36–40 become "L" to hold the indicator lamps 6–10 of the second display region B2 extinguished.

When the lapsed time signal 61*a* has become 5 seconds, only the output of the comparator 26 changes as "L"→"H," and also the output of the AND gate 36 changes as "L"→"H," with the result that the indicator lamp 6 is lit up. Accordingly, assuming that the arrival expectation time signal t be still 30 even at the point of time at which 5 seconds have lapsed since the allotment of the hall call, the display state of the display unit UT1 on this occasion becomes as shown in FIG. 8. As in the prior-art example, the indicator lamps 11A–11D repeat the alternate flickering at the period of 0.5 second, thereby to inform the waiting person of the fact that the displays of the arrival expectation time and the lapsed time are proceeding.

Further, assuming that the cage No. 1 have approached the third floor to change the expectation time signal t from 30 seconds to 25 seconds, 20 seconds, 15 seconds, 10 seconds, 5 seconds and 0 second in succession, the indicator lamps 4, 3, 2 and 1 of the first display region B1 are successively extinguished as explained on the prior-art example. When the lapsed time signal 61*a* has thus changed from 5 seconds to 26 seconds, the outputs of the comparators 27, 28, 29 and 30 change as "L"→"H" in this order, and accordingly, the outputs of the AND gates 37, 38, 39 and 40 change as "L"→"H" in this order. After all, each time 5 seconds lapse, the indicator lamps 7, 8, 9 and 10 of the second display region B2 are successively lit up.

When the cage No. 1 has arrived at the third floor in the up direction, the third-floor up call is canceled to bring the allotment signal 113*u* to "L." Therefore, even if the arrival expectation time signal t has a value of at least 1 second, the indicator lamps 1–5 of the first display region B1, those 6–10 of the second display region B2 and those 11A–11D of the third display region B3 are simultaneously extinguished. In this manner, in this embodiment, the quantity equivalent to the arrival expectation time is displayed in the first display region B1 which corresponds to the upper part of the display unit assimilated to the hourglass, while the quantity equivalent to the lapsed time since the allotment is displayed in the second display region B2 which corresponds to the lower part of the display unit, thereby to bring into agreement the significances of the lighting areas of the respective display regions and the concepts which the waiting person recalls from the hourglass, so that misuderstanding about the display contents can be lessened.

Figure 9:
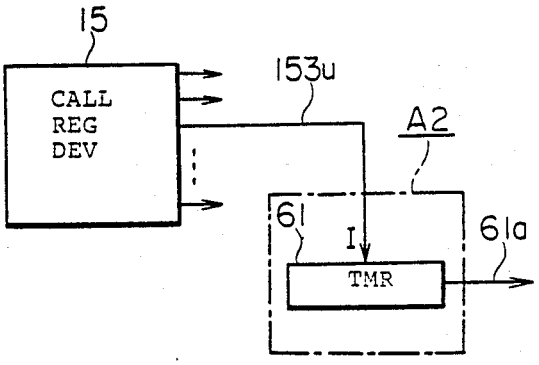

In the foregoing embodiment, the situation in which the cage approaches has been expressed in such a way that the predictive value of the period of time till the arrival of the cage at the hall, namely, the arrival expectation time is displayed in the first display region, while the lapsed time since the assignment of the cage is displayed in the second display region. However, the method of expressing the situation of the approach of the cage is not restricted thereto. As the predictive value of the approach situation of the cage, the number of floors scheduled for transverse across which the cage must travel before arriving at the hall in a predetermined direction may well be employed as clearly stated in the official gazette of Japanese Patent Application Laid-open No. 5141/1977 by way of example, and the number of floors scheduled for stop on which the cage must stop is also employed with ease. Besides, as the lapse value of the situation in which the cage has hitherto approached since the designated point of time, the period of time which has lapsed since the registration of the hall call (corresponding to the period of time for which the waiting person has actually waited in the hall) is easily employed by replacing the allotment signal 113*u* with an output, namely, a third-floor up call signal 153*u* from a well-known call registration device 15 for registering and canceling the hall call as illustrated in FIG. 9 by way of example. It is also easy to employ the number of floors across which the cage has actually traveled, by detecting the changesof a cage position signal, or the number of floors on which the cage has actually stopped, by counting stop determination signals.

As described above, according to the first embodiment, a display apparatus for an elevator wherein a display unit disposed in the cage or hall of the elevator is divided into two display regions not overlapping each other and wherein as the cage approaches the hall, a lighting area in the first display region is gradually decreased, while a lighting area in the second display region is gradually increased, is so constucted that a distance or a period of time which is required for the cage to arrive at the hall is calculated and delivered by first calculation means, while a distance or a period of time by or for which the cage has hitherto approached since a designated point of time is calculated and delivered by second calculation means, and that the quantity corresponding to the output of the first calculation means is displayed in terms of the lighting area of the first display region by first display control means, while the quantity corresponding to the output of the second calculation means is displayed in terms of the lighting area of the second display region by second display control means. Therefore, the significances of the lighting areas of these display regions are not misunderstood by a waiting person, and the waiting person can be prevented from bearing the unnecessary sense of irritation or suspicion.

Next, the second embodiment of this invention will be described with reference to FIGS. 10–13.

Figure 10:
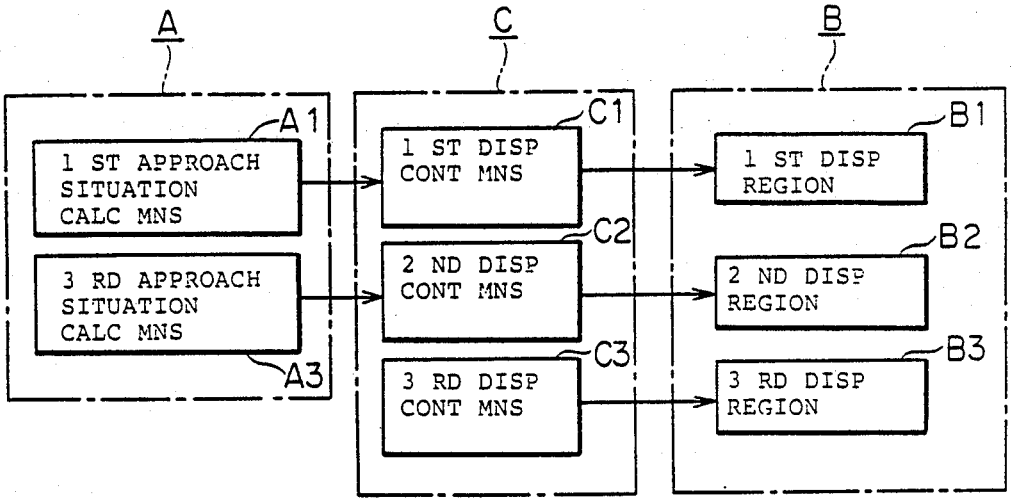

FIG. 10 is a general arrangement diagram for clearly showing the arrangement of the second embodiment of this invention. Approach situation calculation means A is constructed of first calculation means A1 for calculating and delivering a distance or a time interval which is required for a cage to arrive at a hall, and third calculation means A3 for calculating and delivering a distance or a time interval by or for which the cage has hitherto approached since a designated point of time. Display control means C is constructed of first display control means C1 for displaying the quantity corresponding to the output of the first calculation means A1 in terms of the lighting area of the first display region B1 of a display unit B, second display control means C2 for displaying the quantity corresponding to the output of the third calculation means A3 in terms of the lighting area of the second display region B2, and third display control means C3 for periodically changing the lighting aspect of the third display region B3 in order to express that the lighting areas of the first display region B1 and the second display region B2 are being decreased and increased.

Figure 11:
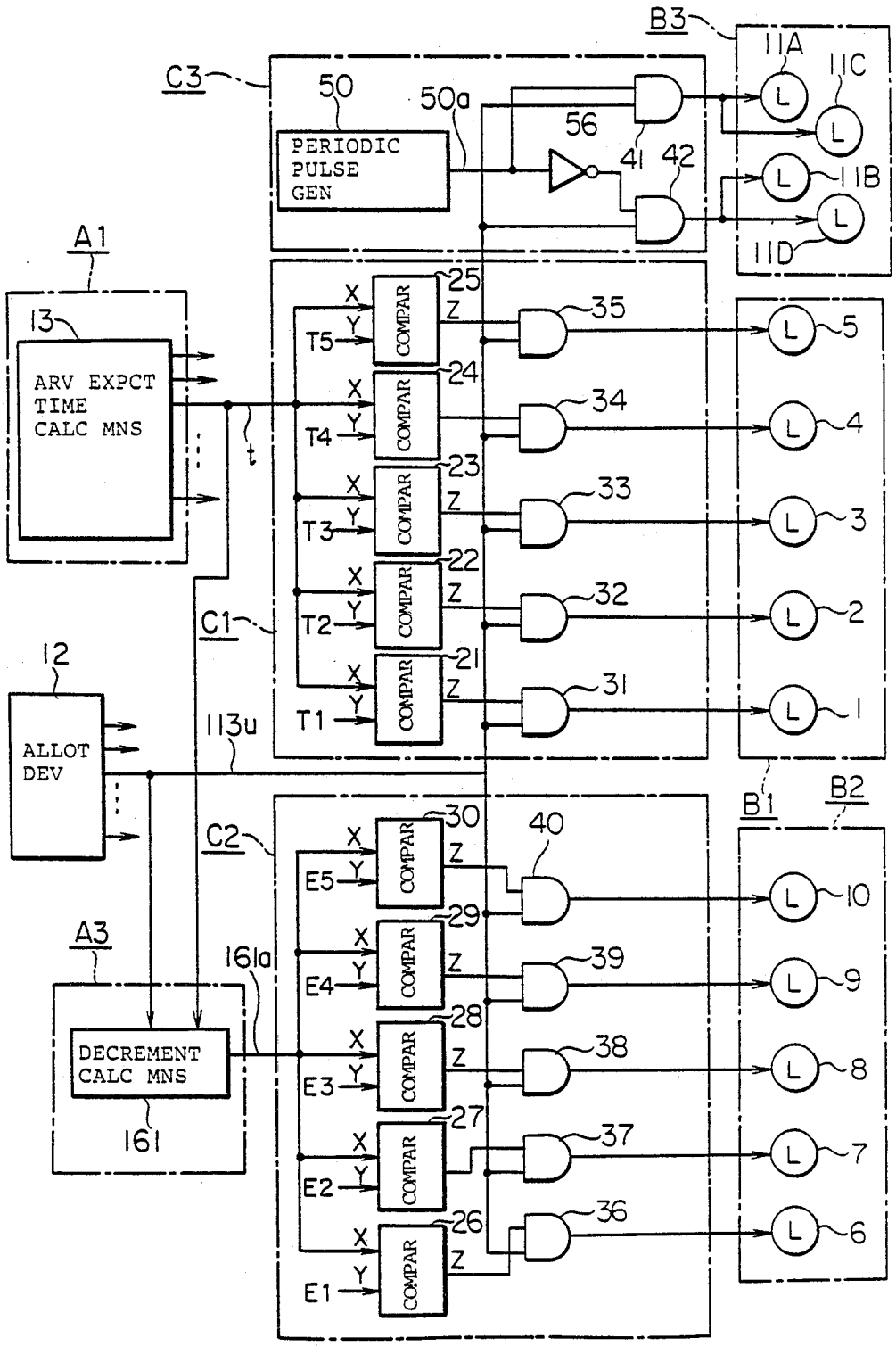

FIG. 11 is a circuit diagram corresponding to FIG. 4 of the prior-art example, and showing that display control circuit C1*u* in the display control means C which controls an up wait time display unit UT1 for the cage No. 1 on the third floor. The display control means C is constructed of similar circuits as regards the down direction, the other floors and the other cage. In FIG. 11, numerals 26–30 indicate comparators which are similar to the comparators 21–25. Symbols E1–E5 denote constant value signals which satisfy the relationship of $E1<E2<E3<E4<E5$, and which are respectively set at 5 seconds, 10 seconds, 15 seconds, 20 seconds and 25 seconds. Numeral 161 denotes a decrement calculation device which stores the arrival expectation time signal t at the point of time of the start of a display, which compares the stored signal and the arrival expectation time signal t at the current point of time so as to evaluate the decrement of the pertinent arrival expectation time, and which provides a decrement signal 161*a*. The decrement calculation device 161 constructs the third calculation means A3.

Figure 12:
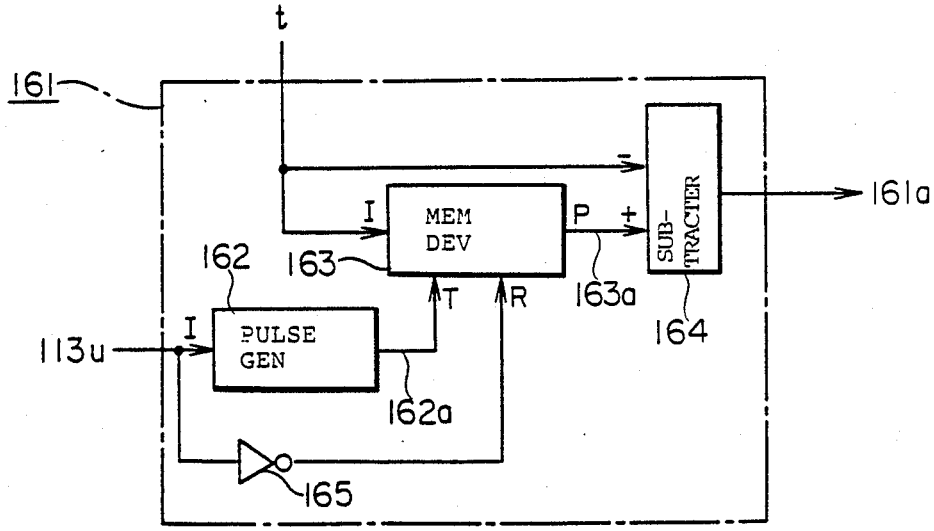

FIG. 12 is a detailed circuit diagram of the decrement calculation device 161. In the figure, numeral 162 denotes a pulse generator for producing a pulse signal 162*a* which becomes "H" for 0.5 second when an input signal at a point I has changed as "L"→"H." A memory device 163 stores the value of an input signal at a point I when the input signal at a point T is "H," and resets the stored content to zero when an input signal at a point R is "H." It delivers the stored content thereof as a reference wait time signal 163*a* from a point P. Numeral 164 indicates a subtracter, and numeral 165 a NOT gate.

Next, the operation of this embodiment will be described.

It is assumed that a waiting person have depressed the up button to register an up call on the third floor, and that the allotment device 12 have assigned the cage No. 1 to this call. Since, at this time, the third-floor up allotment signal 113*u* for the cage No. 1 becomes "H," the display by the indicator lamps 1–10 and 11A–11D becomes possible. Thus, assuming that the third-floor up arrival expectation time signal t for the cage No. 1 have been calculated and delivered as 20 seconds by the arrival expectation time calculation device 13, all the outputs of the comparators 21–24 become "H," so that all the outputs of the AND gates 31–34 become "H" to light up the indicator lamps 1–4 of the first display region B1. Besides, since the output of the comparator 25 becomes "L," the output of the AND gate 35 becomes "L" and the indicator lamp 5 is held extinguished.

Meanwhile, in the decrement calculation device 161, the pulse generator 162 produces the pulse signal 162a when the third-floor up allotment signal 113u for the cage No. 1 has become "H." Therefore, the signal of "H" is applied to the point T of the memory device 163, and the arrival expectation time signal t (=20 seconds) on that occasion is stored. Subsequently, the reference wait time signal 163a is delivered from the point P. Herein, the − point of the subtracter 164 is supplied with the arrival expectation time signal t (=20 seconds), and the + point thereof is supplied with the reference wait time signal 163a (=20 seconds), so that the decrement signal 161a is delivered as zero second. Accordingly, all the outputs of the comparators 26–30 become "L," and all the outputs of the AND gates 36–40 become "L," with the result that the indicator lamps 6–10 of the second display region B2 are all held extinguished. The display state of the display unit UT1 on this occasion becomes as shown in (a) of FIG. 13. As in the prior-art example, the indicator lamps 11A–11D repeat the alternate flickering at the period of 0.5 second, thereby to inform the waiting person of the fact that the displays of the arrival expectation time and the lapsed time are proceeding.

Figure 13:
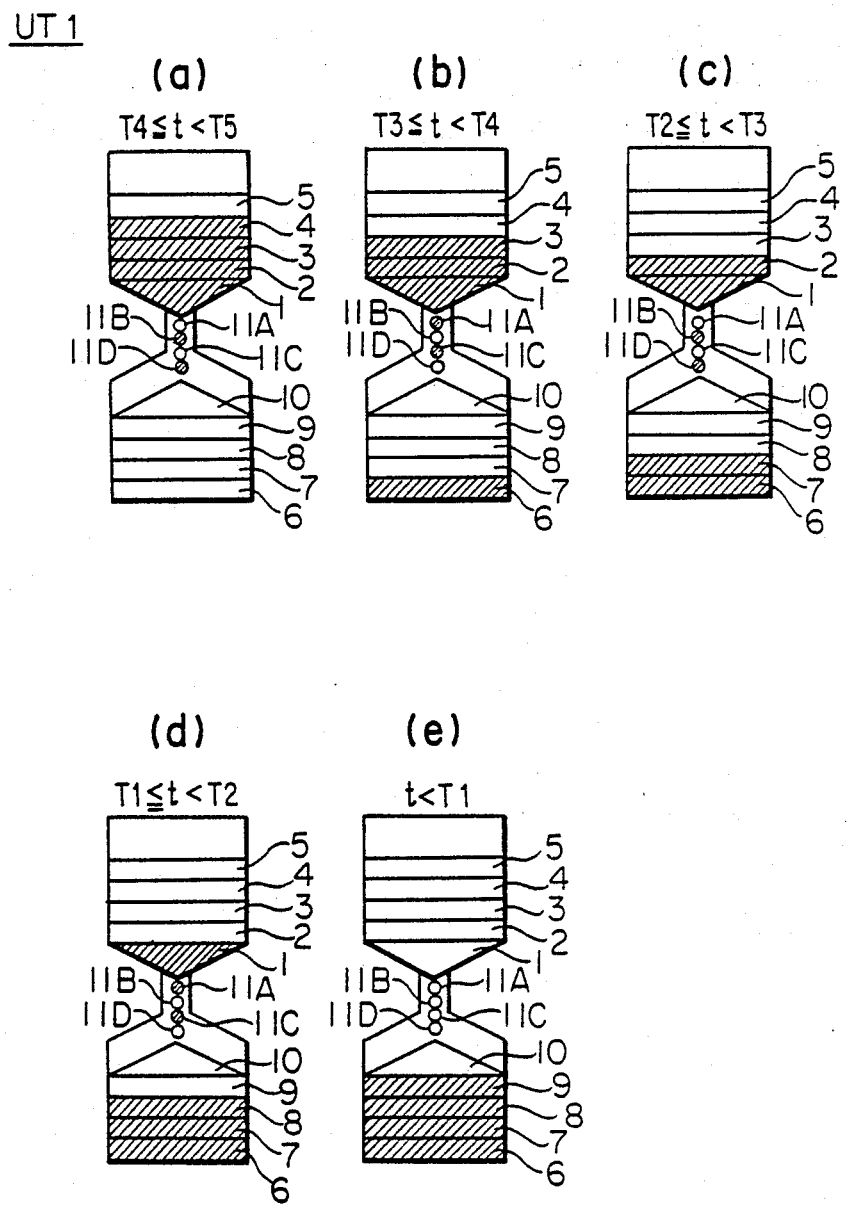

Subsequently, assuming that the cage No. 1 have approached the third floor to change the arrival expectation time signal t from 20 seconds to 15 seconds, 10 seconds, 5 seconds and 0 second in succession, the indicator lamps 4, 3, 2 and 1 of the first display region B1 are successively extinguished as explained on the prior-art example. Since the decrement signal 161a simultaneously changes as 5 seconds, 10 seconds, 15 seconds and 20 seconds, the outputs of the comparators 26, 27, 28 and 29 change as "L"→"H" in this order. Accordingly, the outputs of the AND gates 36, 37, 38 and 39 change as "L"→"H" in this order, and the indicator lamps 6, 7, 8 and 9 of the second display region B2 are successively lit up at intervals of 5 seconds. After all, when the arrival expectation time signal t has changed from 20 seconds to 0 second, the display state changes from (a) to (b), (c), (d) and (e) as shown in FIG. 13.

Thereafter, when the cage No. 1 has arrived at the third floor in the up direction, the third-floor up call is canceled to bring the allotment signal 113u to "L." For this reason, even if the arrival expectation time signal t has a value of at least 1 second, the indicator lamps 1–5 of the first display region B1, those 6–10 of the second display region B2 and those 11A–11D of the third display region B3 are simultaneously extinguished. Besides, in the decrement calculation device 161, when the third-floor up allotment signal 113u for the cage No. 1 has become "L," the output of the NOT gate 165 becomes "H" to apply the signal of "H" to the point R of the memory device 163, so that the stored content of the memory device 163 is reset to zero.

In this manner, in the second embodiment, the quantity equivalent to the arrival expectation time is displayed in the first display region B1 which corresponds to the upper part of the display unit assimilated to the hourglass, while the quantity equivalent to the decrement of the arrival expectation time is displayed in the second display region B2 which corresponds to the lower part of the display unit, so as to increase the lighting area thereof from the null state, thereby to bring into agreement the significances of the lighting areas of the respective display regions and the concepts which the waiting person recalls from the hourglass, so that misunderstanding about the display contents can be lessened.

In the foregoing embodiment, the situation in which the cage approaches has been expressed in such a way that the predictive value of the period of time till the arrival of the cage at the hall, namely, the arrival expectation time is displayed in the first display region, while the decrement of the arrival expectation time since the assignment of the cage is displayed in the second display region. However, the method of expressing the situation of the approach of the cage is not restricted thereto. As the predictive value of the approach situation of the cage, the number of floors scheduled for traverse across which the cage must travel before arriving at the hall in a predetermined direction may well be employed as clearly stated in the official gazette of Japanese Patent Application Laid-open No. 5141/1977 by way of example, and the number of floors scheduled for stop on which the cage must stop is also employed with ease.

As described above, according to the second embodiment, a display apparatus for an elevator wherein a display unit disposed in the cage or hall of the elevator is divided into two display regions not overlapping each other and wherein as the cage approaches the hall, a lighting area in the first display region is gradually decreased, while a lighting area in the second display region is gradually increased, is so constructed that a distance or a period of time which is required for the cage to arrive at the hall is calculated and delivered by first calculation means, that the quantity corresponding to the output of the first calculation means is displayed in terms of the lighting area of the first display region by first display control means, that a quantity in which the output of the first calculation means has decreased by a current point of time since a point of time of the start of the operation of the first display control means is calculated and delivered by third calculation means, and that the lighting area of the second display region is gradually increased from a null state in correspondence with the output of the third calculation means by second display control means. Therefore, the significances of the lighting areas of these display regions are not misunderstood by a waiting person, and the waiting person can be prevented from bearing the unnecessary sense of irritation or suspicion.

Subsequently, the third embodiment of this invention will be described with reference to FIGS. 14–17.

Figure 14:
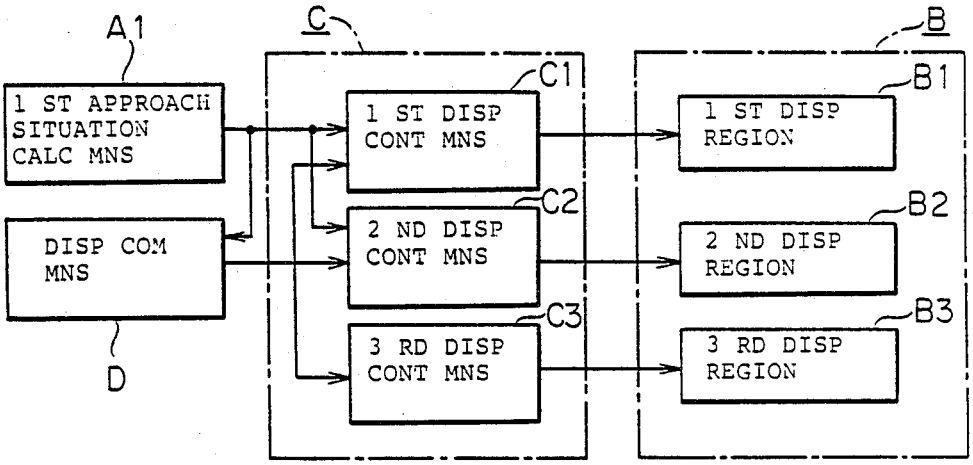

FIG. 14 is a general arrangement diagram for clearly showing the arrangement of the third embodiment of this invention. Display control means C is constructed of first display control means C1 for displaying a quantity corresponding to the output of first calculation means A1 in terms of the lighting area of the first display region B1 of a display unit B, second display control means C2 for increasing the lighting area of the second display region B2 from a designated state with decrease in the lighting area of the first display region B1 when the first display control means C1 has started operating, and third display control means C3 for periodically changing the lighting aspect of the third display region B3 in order to express that the lighting areas of the first display region B1 and the second display region B2 are being decreased and increased. Letter D denotes display command means by which, when the output of the first calculation means A1 exceeds a quantity corresponding to the maximum lighting area of the first display region B1, the first display control means C1 is commanded to establish a display with the maximum lighting area, the second display control means C2 is commanded to establish a display with the minimum lighting area (=zero), and the third display control means C3 is commanded to inhibit the display operation pertinent thereto, and also, when the output of the first calculation means A1 does not exceed the quantity corresponding to the maximum lighting area of the first display area B1, the first display control means C1 is commanded to establish a display with a lighting area corresponding to the output of the first calculation means A1, the second display control means C2 is commanded to establish a display whose lighting area is increased from the state of the minimum lighting area or a larger area in accordance with the decrease of the lighting area of the first display region B1, and the third display control means C3 is commanded to perform the pertinent display operation.

Figure 15:
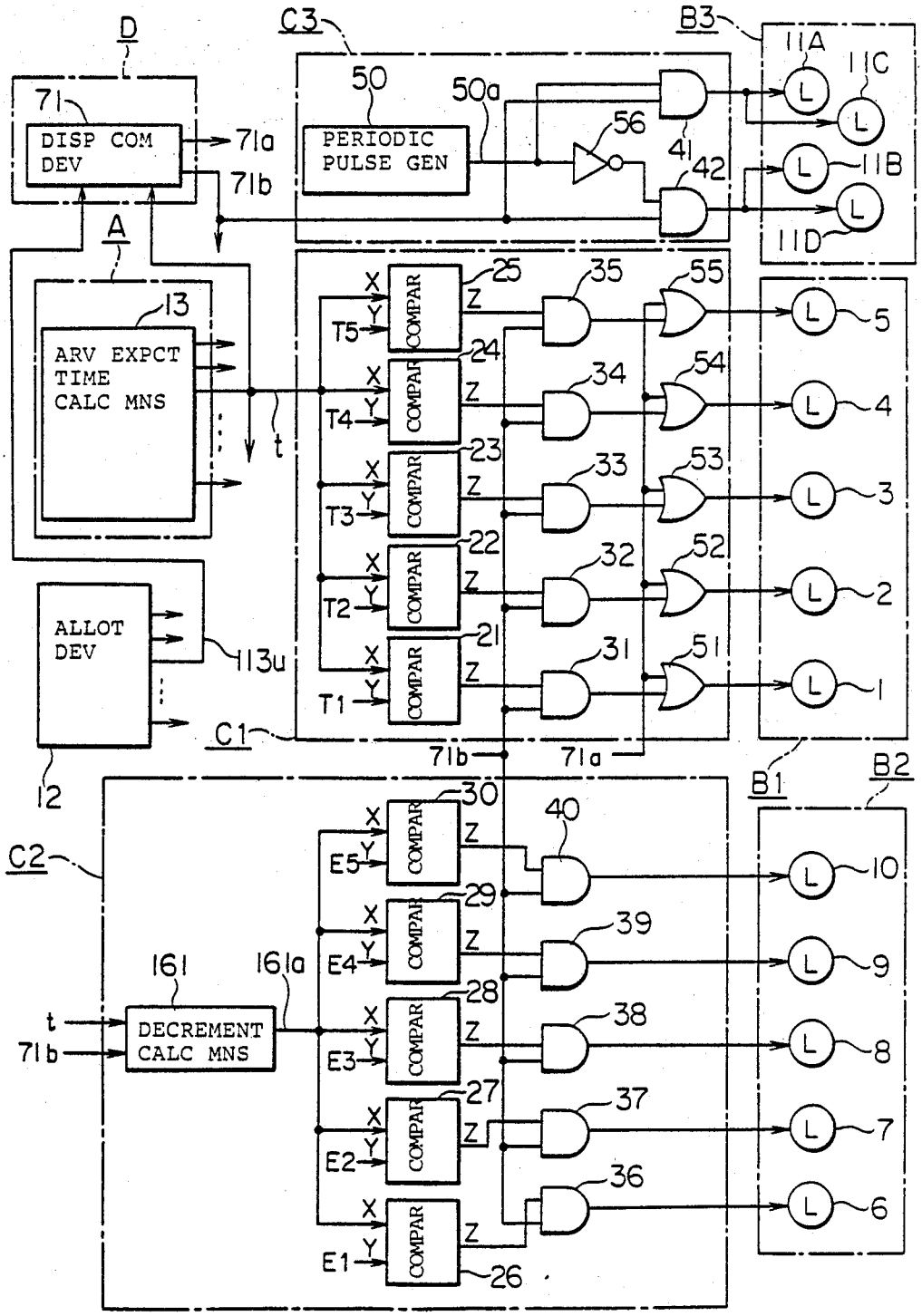

FIG. 15 is a circuit diagram corresponding to FIG. 4 of the prior-art example, and showing that display control circuit C1u in the display control means C which controls an up wait time display unit UT1 for the cage No. 1 on the third floor. The display control means C is constructed of similar circuits as regards the down direction, the other floors and the other cage. In FIG. 15, numerals 26–30 indicate comparators which are similar to the comparators 21–25. Symbols E1–E5 denote constant value signals which satisfy the relationship of E1<E2<E3<E4<E5, and which are respectively set at 5 seconds, 10 seconds, 15 seconds, 20 seconds and 25 seconds. Numerals 51–55 denote OR gates. Numeral 161 denotes a decrement calculation device which stores the third-floor up arrival expectation time signal t of the cage No. 1 arising immediately after a second display command signal 71*b* (to be described later) owing to a display command device 71 (to be described later) has become "H," which compares the stored signal and the arrival expectation time signal t at the current point of time so as to evaluate the decrement of the arrival expectation time, and which provides a decrement signal 161*a*. Shown at numeral 71 is the display command device corresponding to the display command means D, which produces a first display command signal 71*a* that becomes "H" when the cage No. 1 is assigned to the third-floor up call and the arrival expectation time signal t is greater than a constant value signal T6 (to be described later), and the second display command signal 71*b* that becomes "H" when the arrival expectation time signal t is less than the constant value signal T6.

Figure 16:
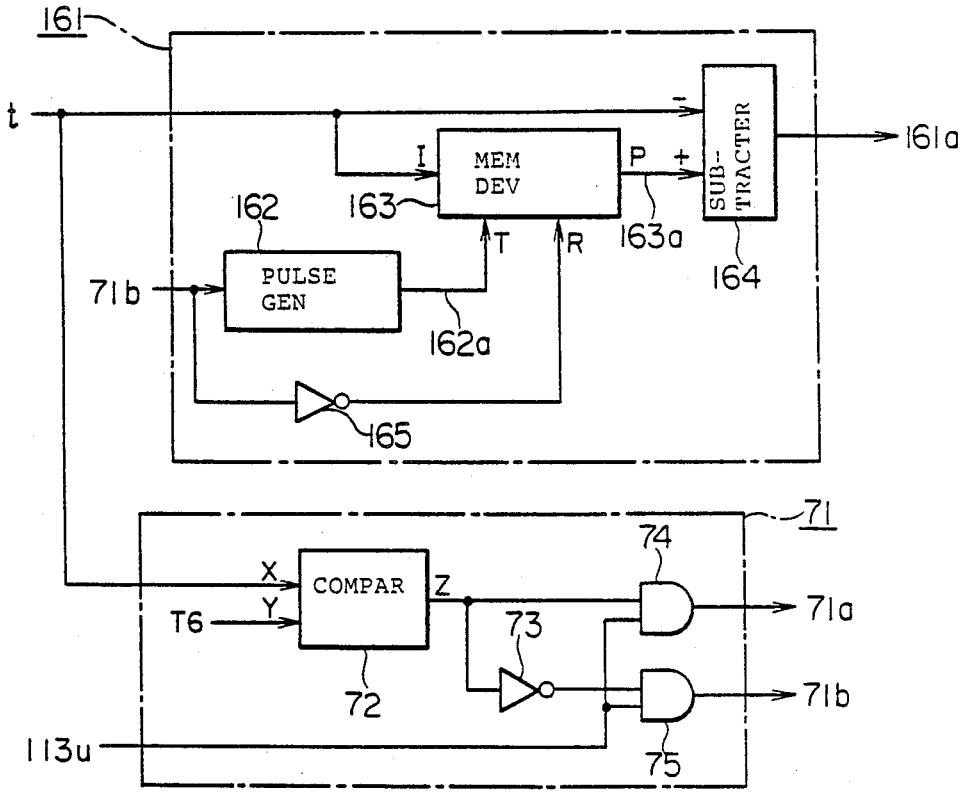

FIG. 16 is a detailed circuit diagram of the decrement calculation device 161 as well as the display command device 71. In the figure, numeral 162 denotes a pulse generator for producing a pulse signal 162*a* which becomes "H" for 0.5 second when an input signal at a point I has changed as "L"→"H." A memory device 163 stores the value of an input signal at a point I when the input signal at a point T is "H," and resets the stored content to zero when an input signal at a point R is "H." It delivers the stored content thereof as a reference wait time signal 163*a* from a point P. Numeral 164 denotes a subtracter, numeral 165 a NOT gate, numeral 72 a comparator similar to the comparator 21, numeral 73 a NOT gate, numerals 74 and 75 AND gates, and symbol T6 the constant value signal expressive of 26 seconds.

Next, the operation of this embodiment will be described.

It is assumed that a waiting person have depressed the up button to register an up call on the third floor, and that the allotment device 12 have assigned the cage No. 1 to this call. On this occasion, it is assumed that the third-floor up arrival expectation time signal t for the cage No. 1 have been calculated and delivered as 40 seconds by the arrival expectation time calculation device 13. Then,in the display command device 71, the output of the comparator 72 is "H," and that of the NOT gate 73 is "L," so that the respective AND gates 74 and 75 bring the first display command signal 71*a* to "H" and the second display command signal 71*b* to "L." Thus, in the display control circuit C1u in FIG. 15, all the outputs of the OR gates 51–55 become "H," so that all the indicator lamps 1–5 of the first display region B1 are lit up, and also, all the outputs of the AND gates 36–40 become "L," so that the indicator lamps 6–10 of the second display region B2 are held extinguished. Besides, both the outputs of the AND gates 41 and 42 become "L," and the periodic flickering display owing to the indicator lamps 11A–11D of the third display region B3 is inhibited. Meanwhile, in the decrement calculation device 161, the output of the NOT gate 165 becomes "H" because of the second display command signal 71*b* of "L," and the signal of "H" is applied to the point R of the memory device 163, the stored content of which is therefore held zero.

Figure 17:
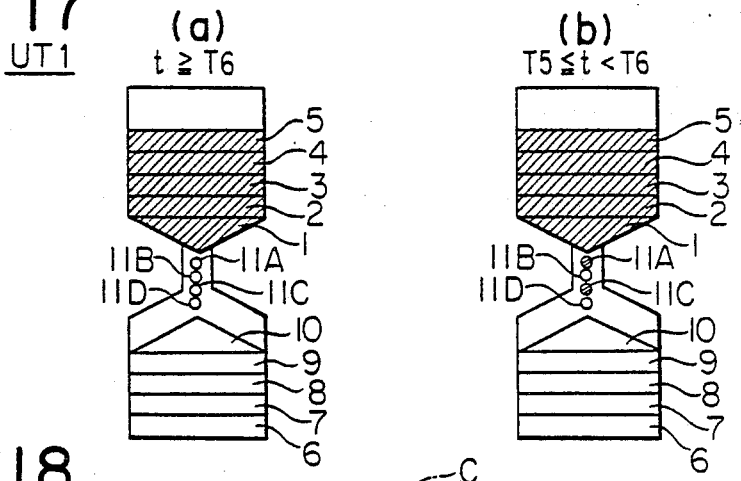

When, in this manner, the third-floor up arrival expectation time t at the time of the allotment of the third-floor up call is not less than the constant value T6 (=26 seconds), the display unit UT1 presents the display as shown in (a) of FIG. 17.

Subsequently, assuming that the cage No. 1 have gradually approached the third floor to calculate and deliver the third-floor up arrival expectation time signal t as 35 seconds, 30 seconds and 25 seconds in succession, the output of the comparator 72 in the display command device 71 becomes "L" immediately after the arrival expectation time signal t has become 25 seconds. Accordingly, the first display command signal 71*a* is brought to "L" and the second display command signal 71*b* to "H" by the NOT gate 73 and the AND gates 74 and 75. Besides, in the decrement calculation device 161, the pulse signal 162*a* is produced by the pulse generator 162 when the second display command signal 71*b* has become "H." Therefore, the signal of "H" is applied to the point T of the memory device 163, and the arrival expectation time signal t (=25 seconds) on that occasion is stored (at this time, the signal of "L" is applied to the point R). Then, since the reference wait time signal 163*a* (=25 seconds) is delivered from the point P, the decrement signal 161*a* is delivered from the subtracter 164 as zero second.

Accordingly, all the outputs of the comparators 21–25 become "H," and hence, all the outputs of the AND gates 31–35 become "H." In the display control circuit C1*u* in FIG. 15, all the outputs of the OR gates 51–55 become "H," so that the indicator lamps 1–5 of the first display region B1 are all held lit up. Besides, since the decrement signal 161*a* is zero second, all the outputs of the comparators 26–30 become "L" and all the outputs of the AND gates 36–40 become "L," so that the indicator lamps 6–10 of the second display region B2 are held extinguished. In addition, since the outputs of the AND gates 41 and 42 become "H" and "L" alternately, the periodic flickering display owing to the indicator lamps 11A–11D of the third display region B3 is started.

Figure 5:
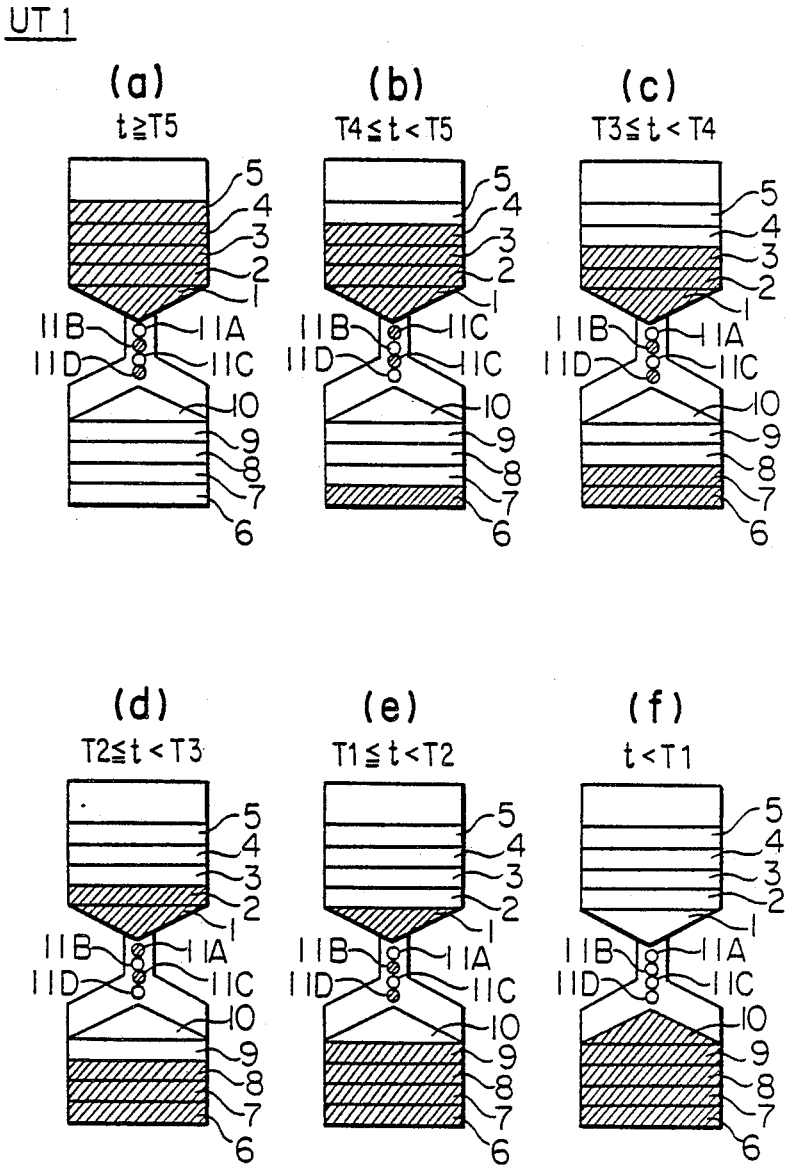

When, in this manner, the arrival expectation time t has become less than the constant value T6 (=26 seconds), the display state of the display unit UT1 becomes as shown in (b) of FIG. 17 (corresponding to (a) in FIG. 5 on the prior-art example). As in the prior-art example, the indicator lamps 11A–11D repeat the alternate flickering at the period of 0.5 second, thereby to inform the waiting person of the fact that the displays of the first display region B1 and the second display region B2 are proceeding.

Subsequently, assuming that the cage No. 1 have more approached the third floor to change the arrival expectation time signal t from 25 seconds to 20 seconds, 15 seconds, 10 seconds, 5 seconds and 0 second in succession, the outputs of the comparators 25, 24, 23, 22 and 21 are successively changed as "H"→"L," and hence, the indicator lamps 5, 4, 3, 2 and 1 of the first display region B1 are successively extinguished at intervals of 5 seconds in accordance with a unit display magnitude display signal 160*a*. Meanwhile, since the decrement signal 161*a* is changed from 0 second to 5 seconds, 10 seconds, 15 seconds, 20 seconds and 25 seconds in succession by the decrement calculation device 161, the outputs of the comparators 26, 27, 28, 29 and 30 are consequently changed as "L"→"H" in this order, and the outputs of the AND gates 36, 37, 38, 39 and 40 are consequently changed as "L"→"H" in this order, so that the indicator lamps 6, 7, 8, 9 and 10 of the second display region B2 are successively lit up at the same intervals of 5 seconds. After all, when the arrival expectation time signal t has changed from 25 seconds to 0 second, the display state changes from (b) of FIG. 17 to (b), (c), (d), (e) and (f) of FIG. 5 likewise to that of the prior-art example. By the way, when teh arrival expectation time signal t is 0 second, the indicator lamps 11A–11D flicker at the period of 0.5 second unlike those of the prior-art example.

Thereafter, when the cage No. 1 has arrived at the third floor in the up direction, the third-floor up call is canceled to bring the allotment signal 113*u* to "L," so that both the first display command signal 71*a* and the second display command signal 71*b* are rendered "L" by the AND gates 74 and 75 of the display command device 71. Accordingly, even if the arrival expectation time signal t has a value of at least 1 second, the indicator lamps 1–5 of the first display region B1, those 6–10 of the second display region B2 and those 11A–11D of the third display region B3 are simultaneously extinguished. Besides, in the decrement calculation device 161, when the second display command signal 71*b* has become "L," the output of the NOT gate 165 becomes "H" to apply the signal of "H" to the point R of the memory device 163, so that the stored content of the memory device 163 is reset to zero, and the reference wait time signal 163*a* is delivered as zero second.

When the third-floor up arrival expectation time t at the allotment of the third-floor up call is less than the constant value T6 (=26 seconds), for example, when it is 15 seconds, the first display command signal 71*a* becomes "L," and the second display command signal 71*b* becomes "H," so that 15 seconds are stored in the memory device 163 by the pulse signal 162*a*, and the reference wait time signal 163*a* is delivered as 15 seconds. Accordingly, the decrement signal 161*a* is delivered as 0 second. The outputs of the comparators 21–23 on this occasion change as "L"→"H," and the outputs of the comparators 26–30 remain at "L," so that the indicator lamps 1–3 of the first display region B1 are lit up, while the indicator lamps 6–10 of the second display region B2 are held extinguished. The indicator lamps 11A–11D of the third display region B3 flicker at the period of 0.5 second. Thenceforth, as the arrival expectation time t changes from 15 seconds to 10 seconds, 5 seconds and 0 second, the indicator lamps 3–1 of the first display region B1 are extinguished in this order, and those 6–8 of the second display region B2 are lit up in this order.

In this manner, in the third embodiment, when the arrival expectation time at the allotment of the hall call exceeds the period of time which corresponds to the maximum lighting area of the first display region of the display unit disposed in the hall, the display of the first display region is presented in the state in which the lighting area thereof is maximized, the display of the second display region is presented in the state in which the lighting area thereof is minimized, and the display operation of the third display region expressive of the falling state of sand is inhibited. On the other hand, when the arrival expectation time at the allotment of the hall call does not exceed the period of time corresponding to the maximum lighting area of the first display region of the display unit, the lighting area of the first display region is gradually decreased in accordance with the arrival expectation time, the lighting area of the second display area is gradually increased in accordance with the decrease of the lighting area of the first display region, and the display operation of the third display region expressive of the falling state of the sand is performed. Therefore, upon seeing whether or not the display expressive of the falling state of the sand is proceeding, the person waiting in the hall can judge whether the wait time till the arrival of the cage is just equal to the maximum displayable time or longer, and he/she can be relived from bearing the sense of suspicion or irritation unnecessarily.

As described above, according to the third embodiment, a display apparatus for an elevator in which a display unit disposed in the cage or hall of the elevator is endowed with three sorts of display regions, and which has first calculation means for calculating and delivering a distance or a time interval required for the cage to arrive at the hall, display command means for delivering a command for operating the display unit while a condition previously determined for the hall holds, first display control means for displaying the quantity corresponding to the output of the first calculation means in terms of the lighting area of the first display area when the display command means is operating, second display control means for presenting a display by increasing the lighting area of the second display region in accordance with the decrease of the lighting area of the first display region when the display command means is operating, and third display control means for displaying in terms of the change of the lighting aspects of the third display region the fact that the first display control means and the second control means are respectively performing the decremental operation and the incremental operation, is so constructed that when the output of said first calculation means exceeds the quantity corresponding to the maximum lighting area of said first display region, said display command means commands said first display control means to present the display with the maximum lighting area, commands said second display control means to present the display with the minimum lighting area, and commands said third display contol means to inhibit the display operation thereof, and that when the output of said first calculation means does not exceed the quantity corresponding to the maximum lighting area of said first display region, said display command means commands said first display control means to present the display with the corresponding lighting area, commands said second display control means to present the display while increasing the lighting area of said second display region in accordance with the decrease of the lighting area of said first display region, and commands said third display control means to perform the display operation thereof. It is therefore possible to relieve a waiting person from bearing the sense of irritation or suspicion unnecessarily.

In the next place, the fourth embodiment of this invention will be described with reference to FIGS. 18–21.

Figure 18:
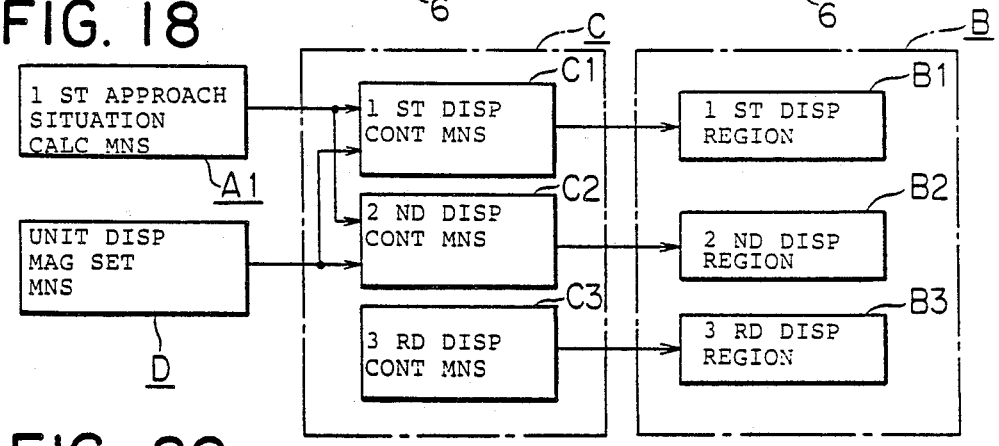

FIG. 18 is a general arrangement diagram for clearly showing the arrangement of the fourth embodiment of this invention. Unit display magnitude setting means D sets a display magnitude per unit display region in accordance with the output of first calculation means A1 at the point of time of the start of a display. Display control means C is constructed of first display control means C1 for displaying a quantity corresponding to the output of the first calculation means A1, so as to decrease on the basis of the unit display magnitude of the unit display magnitude setting means D from the state in which the lighting area of the first display region B1 of a display unit B is maximized, second display control means C2 for presenting a display so as to increase the lighting area of the second display region B2 with the decrease of the output of the first calculation means A1 on the basis of the unit display magnitude of the unit display magnitude setting means D from the state in which this lighting area is minimized, and third display control means C3 for periodically changing the lighting aspect of the third display region B3 in order to express that the lighting areas of the first display region B1 and the second display region B2 are being decreased and increased. By the way, the first display region B1 is composed of five unit display regions expressed by indicator lamps 1–5, while the second display region B2 is composed of five unit display regions expressed by indicator lamps 6–10.

Figure 19:
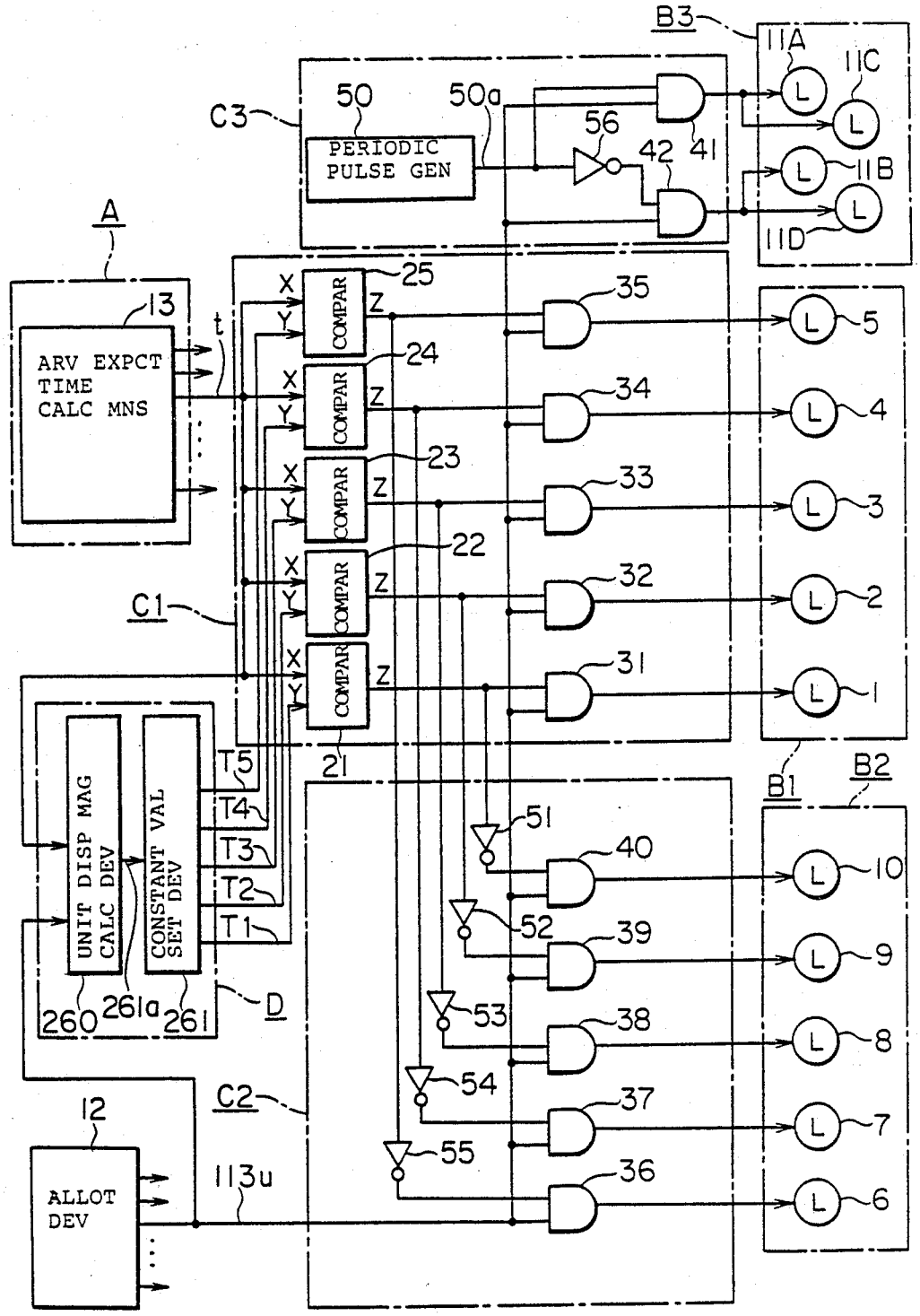

FIG. 19 is a circuit diagram corresponding to FIG. 4 of the prior-art example, and showing that display control circuit C1*u* in the display control means C which controls an up wait time display unit UT1 for the cage No. 1 on the third floor. The display control means C is constructed of similar circuits as regards the down direction, the other floors and the other cage. In FIG. 19, numeral 260 denotes a unit display magnitude calculation device which stores the arrival expectation time signal t at the point of time of the allotment of a third-floor up call, which divides the stored signal by the number of the unit display regions to evaluate a display magnitude per unit display region, and which delivers a unit display magnitude signal 260*a*. Shown at numeral 261 is a constant value setting device which sets and delivers constant value signals T1–T5 on the basis of the unit display magnitude signal 260*a*, and which constitutes the unit display magnitude setting means D. In this embodiment, the arrival expectation time calculation device 13 is assumed to deliver the arrival expectation time signals t at intervals of 1 second.

Figure 20:
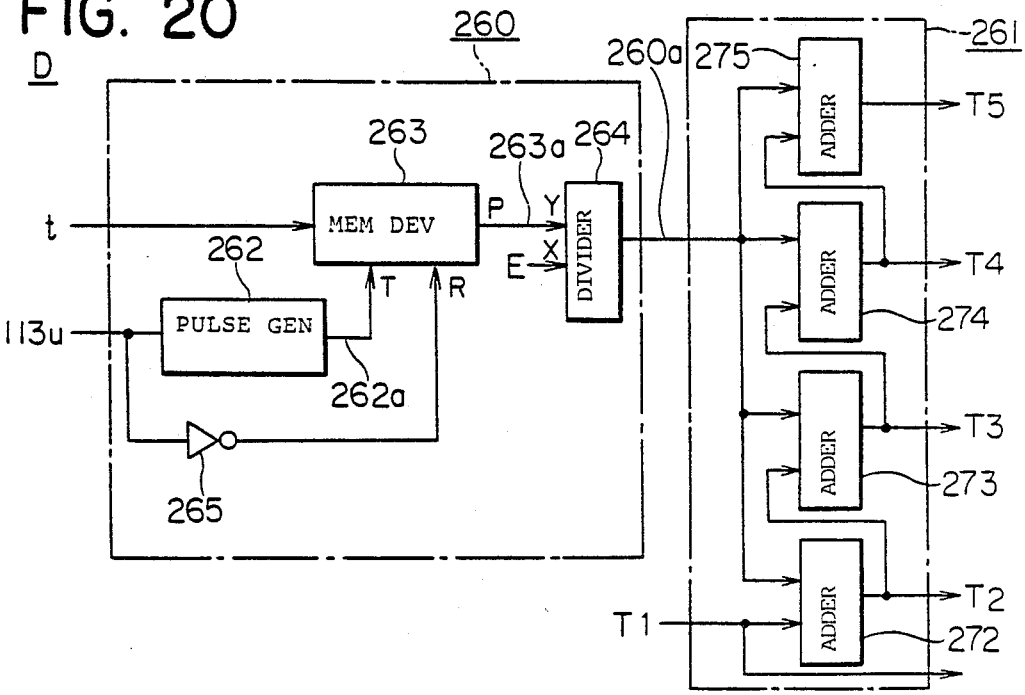

FIG. 20 is a detailed circuit diagram of the unit display magnitude calculation device 260 as well as the constant value setting device 261. In the figure, numeral 262 denotes a pulse generator for producing a pulse signal 262*a* which becomes "H" for 0.5 second when an input signal at a point I has changed as "L"→"H." A memory device 263 stores the value of an input signal at a point I when the input signal at a point T is "H," and resets the stored content to zero when an input signal at a point R is "H." It delivers the stored content thereof as a reference wait time signal 263*a* from a point P. Numeral 264 denotes a divider for delivering a quotient obtained in such a way that the value of the input signal of a point Y is divided by the value of the input signal of a point X, numeral 265 denotes a NOT gate, letter E denotes a constant value signal expressive of the number (=5) of the unit display regions, and numerals 272–275 denote adders. The constant value signal T1 is set at 1 second beforehand.

Next, the operation of this embodiment will be described.

It is assumed that a waiting person have depressed the up button to register an up call on the third floor, and that the allotment device 12 have assiged the cage No. 1 to this call. Since, at this time, the third-floor up allotment signal 113*u* for the cage No. 1 becomes "H," the display by the indicator lamps 1–10 and 11A–11D becomes possible. On this occasion, it is assumed that the third-floor up arrival expectation time signal t for the cage No. 1 have been calculated and delivered as 20 seconds by the arrival expectation time calculation device 13. Then, in the unit display magnitude calculation device 260, the pulse signal 262*a* is produced by the pulse generator 262 when the third-floor up allotment signal 113*u* for the cage No. 1 has become "H." Therefore, the signal of "H" is applied to the point T of the memory device 263, and the arrival expectation time signal t (=20 seconds) on that occasion is stored. Subsequently, the reference wait time signal 263*a* (=20 seconds) is delivered from the point P, so that the unit display magnitude signal 260*a* is provided as 20 seconds÷5=4 seconds by the divider 264. Further, in the constant value setting device 261, the constant value signal T2 is delivered as 5 seconds in such a way that the constant value signal T1 (=1 second) and the unit display magnitude signal 260*a* (=4 seconds) are added by the adder 272. Likewise, the constant value signals T3–T5 are respectively delivered as 9 seconds, 13 seconds and 17 seconds by the adders 273–275.

Accordingly, all the outputs of the comparators 21–25 become "H," and hence, all the outputs of the AND gates 31–35 become "H," to light up all the indicator lamps 1–5 of the first display region B1.

Besides, all the outputs of the NOT gates 51–55 become "L," and all the outputs of the AND gates 36–40 become "L," so that the indicator lamps 6–10 of the second display region B2 are all held extinguished. The display state of the display unit UT1 on this occasion becomes as shown in (a) of FIG. 21. As in the prior-art example, the indicator lamps 11A–11D repeat the alternate flickering at the period of 0.5 second, thereby to inform the waiting person of the fact that the displays of the first display region B1 and the second display region B2 are proceeding.

Figure 21:
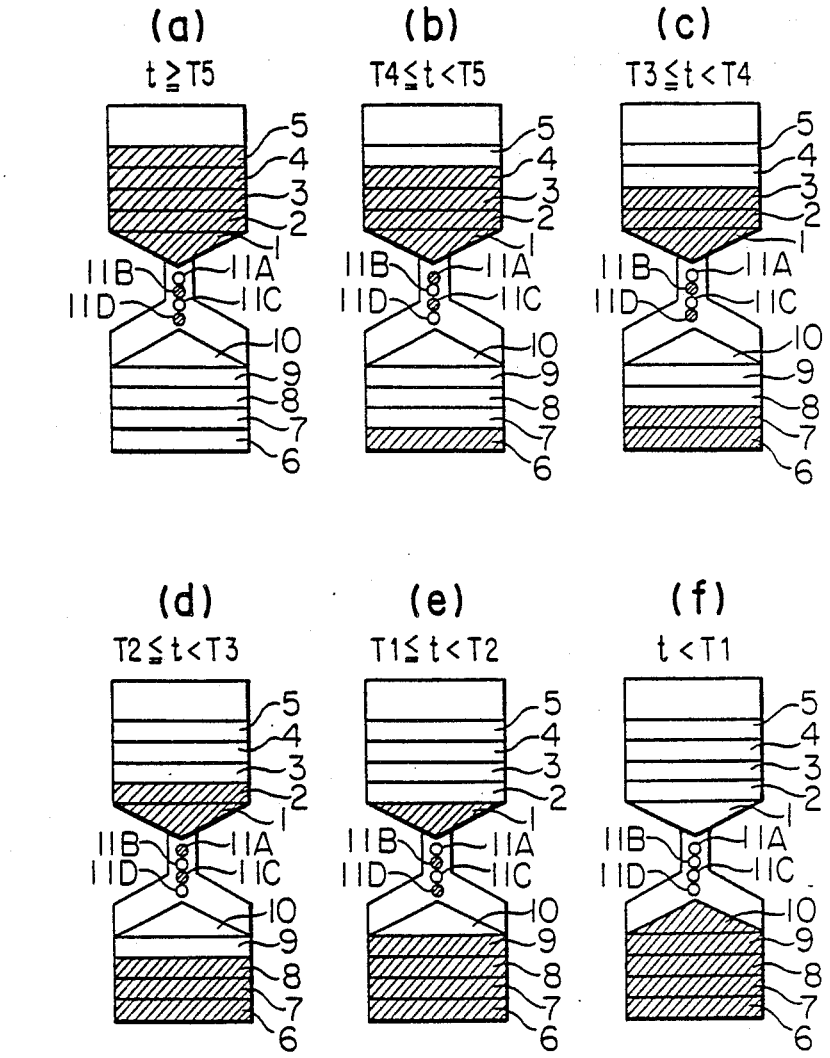

Subsequently, assuming that the cage No. 1 have approached the third floor to change the arrival expectation time signal t from 20 seconds to 16 seconds, 12 seconds, 8 seconds, 4 seconds and 0 second in succession, the outputs of the comparators 25, 24, 23, 22 and 21 are successively changed as "H"→"L," and hence, the indicator lamps 5, 4, 3, 2 and 1 of the first display region B1 are successively extinguished at intervals of 4 seconds in accordance with the unit display magnitude display signal 260a. The outputs of the NOT gates 55, 54, 53, 52 and 51 are consequently changed as "L"→"H" in this order, and the outputs of the AND gates 36, 37, 38, 39 and 40 are consequently changed as "L"→"H" in this order, so that the indicator lamps 6, 7, 8, 9 and 10 of the second display region B2 are successively lit up at the same intervals of 4 seconds. After all, when the arrival expectation time signal t has changed from 20 seconds to 0 second, the display state changes from (a) to (b), (c), (d), (e) and (f) as shown in FIG. 21.

Thereafter, when the cage No. 1 has arrived at the third floor in the up direction,the third-floor up call is canceled to bring the allotment signal 113u to "L." For this reason, even if the arrival expectation time signal t has a value of at least 1 second, the indicator lmaps 1–5 of the first display region B1, those 6–10 of the second display region B2 and those 11A–11D of the third display region B3 are simultaneously extinguished. Besides, in the unit display magnitude calculation device 260, when the third-floor up allotment signal 113u for the cage No. 1 has become "L," the output of the NOT gate 265 becomes "H" to apply the signal of "H" to the point R of the memory device 263, so that the stored content of the memory device 263 is reset to zero, and the unit display magnitude signal 260a is delivered as zero second. Accordingly, all the constant value signals T1–T5 are set at 1 second in the constant value setting device 261.

Next, in a case where the third-floor up arrival expectation time signal t at the point of time at which the third-floor up call has been allotted to the cage No. 1 is calculated and delivered as 40 seconds, the unit display magnitude signal 260a becomes $40 \div 5 = 8$ (seconds). In this case, therefore, the displays shown at (a)–(f) in FIG. 21 are successively presented at a speed equal to ½ of the speed in the case where the arrival expectation time signal t is 20 seconds.

In this manner, in the fourth embodiment, the unit display magnitude of the display unit assimilated to the hourglass is set in accordance with the magnitude of the arrival expectation time at the allotment of the hall call, and the quantity equivalent to the arrival expectation time is displayed in the first display region B1 corresponding to the upper part of the display unit so as to decrease on the basis of the unit display magnitude from the state in which the lighting area is maximized, while the quantity equivalent to the decrement of the arrival expectation time is displayed in the second display region B2 corresponding to the lower part of the hourglass so as to increase on the basis of the unit display magnitude from the state in which the lighting area is null, thereby to bring into agreement the significances of the lighting areas of the respective display regions and the concepts which the waiting person recalls from the hourglass, and to clarify the the intermediate time lapse. It is therefore possible to lessen misunderstanding about the display contents and to relieve the waiting person from bearing the unnecessary sense of irritation.

In the foregoing embodiment, the situation in which the cage approaches has been expressed in such a way that the predictive value of the period of time till the arrival of the cage at the hall, namely, the arrival expectation time is displayed in the first display region, while the decrement of the arrival expectation time since the assignment of the cage is displayed in the second display region. However, the method of expressing the situation of the approach of the cage is not restricted thereto. As the predictive value of the approach situation of the cage, the number of floors scheduled for traverse across which the cage must travel before arriving at the hall in a predetermined direction may well be employed as clearly stated in the official gazette of Japanese Patent Application Laid-open No. 5141/1977 by way of example, and the number of floors scheduled for stop on which the cage must stop is also employed with ease.

Besides, in the fourth embodiment, the numbers of the unit display regions of the first display region and the second display region are respectively set equal at five, they need not always be equalized. It is to be understood that, when the numbers of the unit display regions are not equal, the unit display magnitudes per unit display region may be set for the respective display regions. Further, this invention is applicable even to a case where each of the first display region and the second display region is subdivided into a plurality of regions of unequal display areas. By way of example, a region corresponding to the greatest common measure of the display areas is handled just as the unit display region, and the display magnitudes expressed by the divided regions may be set according to the respective display areas.

As described above, according to the fourth embodiment, a display apparatus for an elevator wherein a display unit disposed in the cage or hall of the elevator is divided into two display regions and wherein as the cage approaches the hall, a lighting area in the first display region is gradually decreased, while a lighting area in the second display region is gradually increased, is so constructed that each of the display regions includes a plurality of unit display regions, that a distance or a time interval required for the cage to arrive at the hall is calculated and delivered by first calculation means, that a distance or a time interval expressed per unit display region is set according to the output of the first calculation means at the point of time of the start of display by unit display magnitude setting means, that the display is started by first display control means from a state in which the number of the unit display regions lit up within the first display region is set at the maximum number, whereupon as the output of the first calculation means becomes smaller, the number of the unit display regions lit up within the first display region is decreased more on the basis of the unit display magnitude set by the unit display magnitude setting means, and that the display is started by second display control means from a state in which the number of the unit display regions lit up within the second display region is set at the minimum number, whereupon as.the output of the first calculation means becomes smaller, the number of the unit display regions lit up within the second display region is increased more on the basis of the unit display magnitude set by the unit display magnitude setting means. Therefore, the significances of the lighting areas of these display regions are not misunderstood by a waiting person, and the waiting person can be prevented from bearing the unnecessary sense of irritation or suspicion.

In the first to fourth embodiments, unlike the prior-art example, when the cage has arrived, the indicator lamps 1–10 and 11A–11D of the first–third display regions are all extinguished. However, it is also easy that a quantity corresponding to the decrement of the arrival expectation time at the point of time of the arrival is displayed in the second display region until a door opening operation is started.

Besides, in each of the first-fourth embodiments, the display units are disposed for individual directions. However, only one display unit serving for both the up and down directions may well be installed so as to display the approach situation of the cage in the direction in which the cage arrives earlier. Also, this invention is applicable, not only to the display unit installed in the hall, but also to the display unit installed in the cage.

Further, in each of the first to fourth embodiments, the approach situation of the cage is displayed in six stages, but the display stages are not restricted thereto. It is to be understood that the approach situation can be displayed in more detail when an LED, liquid crystal or plasma display is employed or graphic display based on a CRT is utilized. Even when a plurality of lighting colors are used for the display unit and a portion to be extinguished (background) is displayed in another lighting color, the effects of this invention are not spoilt.

Further, in the first to fourth embodiments, the display unit is constructed like the hourglass, but it need not always be quite similar to the hourglass. The approach situation of the cage can be readily understood by association with the hourglass as long as the display region of the display unit is divided into two display regions, whereupon the lighting area of one display region is gradually decreased and that of the other display region is gradually increased with the approach of the cage to the hall.

What is claimed is:

1. In a display apparatus for an elevator wherein a display unit disposed in a cage or a hall of the elevator is divided into two display regions, and as the cage approaches the hall, a lighting area in the first display region is gradually decreased, while a lighting area in the second display region is gradually increased; a display apparatus for an elevator comprising first calculation means for calculating and delivering a distance or a period of time which is required for the cage to arrive at the hall, second calculation means for calculating and delivering a movement distance or a lapsed time which is taken with respect to a designated point of time, first display control means for displaying the quantity corresponding to the output of said first calculation means, in terms of the lighting area of said first display region, and second display control means for displaying the quantity corresponding to the output of said second calculation means, in terms of the lighting area of said second display region.

2. A display apparatus for an elevator as defined in claim 1 wherein said first calculation means calculates and delivers a number of floors across which the cage must travel before arriving at the hall, while said second calculation means calculates and delivers a number of the floors across which the cage has hitherto traveled since a start of the operation of said first calculation means.

3. A display apparatus for an elevator as defined in claim 1 wherein said first calculation means calculates and delivers a number of scheduled stops in which the cage must stop before arriving at the hall, while said second calculation means calculates and delivers a number of actual stops in which the cage has hitherto stopped since a start of the operation of said first calculation means.

4. A display apparatus for an elevator as defined in claim 1 wherein said first calculation means calculates and delivers a predictive value of the period of time which is required for the cage to arrive at the hall, while said second calculation means calculates and delivers the period of time which has hitherto lapsed since a start of the operation of said first calculation means.

5. A display apparatus for an elevator as defined in claim 1 wherein said first calculation means calculates and delivers a predictive value of the period of time which is required for the cage to respond to a call of the hall and to arrive at the hall, while said second calculation means calculates and delivers the period of time which has hitherto lapsed since registration of the call of the hall.

6. A display apparatus for an elevator as defined in claim 1 wherein said second calculation means is constructed of a timer which measures the period of time in response to an allotment signal for a hall call.

7. A display apparatus for an elevator as defined in claim 1 wherein said display unit is in the shape of an hourglass.

8. In a display apparatus for an elevator wherein a display unit disposed in a cage or a hall of the elevator is divided into two display regions not overlapping each other, and as the cage approaches the hall, a lighting area in the first display region is gradually decreased, while a lighting area in the second display region is gradually increased correspondingly; a display apparatus for an elevator comprising first calculation means for calculating and delivering a distance or a period of time which is required for the cage to arrive at the hall; first display control means for displaying a quantity corresponding to the output of said first calculation means, in terms of the lighting area of said first display region, third calculation means for calculating and delivering a quantity in which the output of said first calculation means has decreased by a current point of time since a point of time of a start of the operation of said first display control means, and second display control means for gradually increasing the lighting area of said second display region from a null state in correspondence with the output of said third calculation means.

9. A display apparatus for an elevator as defined in claim 8 wherein said first calculation means is an arrival expectation time calculation device.

10. A display apparatus for an elevator as defined in claim 9 wherein said third calculation means is a decrement calculation device comprising a memory device which stores an arrival expectation time provided by said arrival expectation time calculation device when an allotment signal of a hall call has been received, and a subtracter which subtracts an arrival expectation time provided by said arrival expectation time calculation device at the current point of time, from the arrival expectation time stored in said memory device and which delivers the difference as the decremental quantity.

11. In a display apparatus for an elevator having:

a display unit which is disposed in a cage or a hall of the elevator, and which has three sorts of display regions, first calculation means to calculate and deliver a distance or a time interval required for the cage to arrive at the hall, display command means to deliver a command for operating the display unit while a condition previously determined for the hall holds, first display control means to display a quantity corresponding to the output of the first calculation means in terms of a lighting area of the first display region when the display command means is operating, second display control means to present a display while increasing a lighting area of the second display region in accordance with decrease in the lighting area of the first display region when the display command means is operating, and third display control means to display it in terms of a change of lighting aspects of the third display region that the first display control means and the second display control means are respectively performing the decremental operation and the incremental operation;

a display apparatus for an elevator characterized in that when the output of said first.calculation means exceeds a quantity corresponding to a maximum lighting area of said first display region, said display command means commands said first display control means to present the display with the maximum lighting area, commands said second display control means to present the display with a minimum lighting area, and commands said third display control means to inhibit the display operation thereof, and that when the output of said first calculation means does not exceed the quantity corresponding to the maximum lighting area of said first display region, said display command means commands said first display control means to present the display with a lighting area correspondin to the output, commands said second display control means to present the display while increasing the lighting area of said second display region in accordance with the decrease of the lighting area of said first display region, and commands said third display control means to perform the display operation thereof.

12. A display apparatus for an elevator as defined in claim 11 wherein said display command means is constructed of a comparator which compares the output of said first calculation means and a set quantity corresponding to the maximum lighting area of said first display region, and a decision circuit which supplies control signals to said first to third display control means in accordance with an output from said comparator.

13. A display apparatus for an elevator as defined in claim 12 wherein said first calculation means calculates an arrival expectation time.

14. A display apparatus for an elevator as defined in claim 1 wherein said comparator compares the arrival expectation time fed from said first calculation means and an arrival expectation time previously set in correspondence with the maximum lighting area of said first display region.

15. In a display apparatus for an elevator wherein a display unit disposed in a cage or a hall of the elevator is divided into two display regions and wherein as the cage approaches the hall, a lighting area in the first display region is decreased gradually, while a lighting area in the second display region is correspondingly increased gradually; a display apparatus for an elevator comprising a plurality of unit display regions included in each of said display regions, first calculation means for calculating and delivering a distance or a time interval required for the cage to arrive at the hall, unit display magnitude setting means for setting a distance or a time interval expressed per unit display region, according to the output of said first calculation means at a start point of display, first display control means for starting the display from a state in which a number of the unit display regions lit up within said first display region is set at a maximum number, and for decreasing the number of said unit display regions lit up within said first display region, with the decrease of the output of said first calculation means and on the basis of the unit display magnitude set by said unit display magnitude setting means, and second display control means for starting the display from a state in which a number of the unit display regions lit up within said second display region is set at a minimum number, and for increasing the number of said unit display regions lit up within said second display region, with the decrease of the output of said first calculation means and on the basis of the unit display magnitude set by said unit display magnitude setting means.

* * * * *